US010012950B2

(12) United States Patent
Eto

(10) Patent No.: US 10,012,950 B2
(45) Date of Patent: Jul. 3, 2018

(54) IMAGE FORMING APPARATUS

(71) Applicant: KYOCERA Document Solutions Inc., Osaka-shi (JP)

(72) Inventor: Daisuke Eto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/688,952

(22) Filed: Aug. 29, 2017

(65) Prior Publication Data

US 2018/0067451 A1 Mar. 8, 2018

(30) Foreign Application Priority Data

Sep. 5, 2016 (JP) ..... 2016-172526
Sep. 5, 2016 (JP) ..... 2016-172551

(51) Int. Cl.
*G03G 21/18* (2006.01)
*G03G 15/08* (2006.01)

(52) U.S. Cl.
CPC ..... *G03G 21/1842* (2013.01); *G03G 15/0896* (2013.01); *G03G 2221/163* (2013.01); *G03G 2221/1846* (2013.01)

(58) Field of Classification Search
CPC ..... G03G 21/1842
See application file for complete search history.

(56) References Cited

U.S. PATENT DOCUMENTS

2005/0191090 A1* 9/2005 Nishimura ..... G03G 21/1821 399/113
2008/0219700 A1* 9/2008 Saiki ..... G03G 15/20 399/122
2012/0275820 A1 11/2012 Eto

FOREIGN PATENT DOCUMENTS

JP 2012-230280 11/2012

* cited by examiner

*Primary Examiner* — Clayton E Laballe
*Assistant Examiner* — Jas Sanghera
(74) *Attorney, Agent, or Firm* — Gerald E. Hespos; Michael J. Porco; Matthew T. Hespos

(57) ABSTRACT

A printer 100 includes a housing, an image forming unit 120H, a body unit 150, positioning mechanisms and a lock lever 50. The positioning mechanism includes a unit biasing spring and a biasing projection, and positions the image forming unit 120H by biasing the image forming unit 120H mounted at a first position in the housing. The lock lever 50 is pivotably provided on the image forming unit 120H. The lock lever 50 can change the posture thereof between a first posture for locking the image forming unit 120H at the first position and a second posture for unlocking the image forming unit 120H and allowing the image forming unit 120H to be removed from the housing.

9 Claims, 21 Drawing Sheets

IMAGE FORMING APPARATUS

This application is based on Japanese Patent Applications No. 2016-172551 and No. 2016-172526 filed with the Japan Patent Office on Sep. 5, 2016, the contents of which are hereby incorporated by reference.

BACKGROUND

The present disclosure relates to an image forming apparatus for forming an image on a sheet.

Conventionally, an image forming apparatus with an apparatus body, a photoconductive drum (image carrier) and a developing device is known as an image forming apparatus for forming an image on a sheet. The developing device includes a developing roller facing the photoconductive drum. Further, a technique for making a developing device mountable into and removable from an apparatus body is known.

A developing device is, as an image forming unit, mounted into and removed from an apparatus body. The apparatus body includes a rail member and a cut portion formed on one end of the rail member. On the other hand, the image forming unit includes a roller rotatable on the rail member. In mounting the image forming unit, the roller is detached from the rail member and inserted into the cut portion, whereby the image forming unit is positioned at a predetermined position in the apparatus body.

SUMMARY

An image forming apparatus according to one aspect of the present disclosure includes a an apparatus body, an image forming unit mountable into and removable from the apparatus body along predetermined mounting and removing directions, a guide unit arranged in the apparatus body and configured to guide the mounting and removal of the image forming unit, a positioning mechanism arranged in the guide unit, including a first biasing member and a unit contact portion configured to come into contact with the image forming unit by receiving a biasing force of the first biasing member, and configured to bias the image forming unit mounted at a first position in the apparatus body and position the image forming unit, and a lever member pivotably provided on the image forming unit and capable of changing the posture thereof between a first posture for locking the image forming unit at the first position in the apparatus body and a second posture for unlocking the image forming unit and allowing the image forming unit to be removed from the apparatus body along the removing direction. The guide unit includes a guide surface configured to guide the image forming unit, and an engaged portion arranged more forward than the guide surface in the mounting direction of the image forming unit. The lever member includes a pivot portion serving as a pivot in a pivotal movement, a pressed portion to be pressed to remove the image forming unit from the apparatus body, a hook arranged on a side opposite to the pressed portion across the pivot portion, rotatable about the pivot portion and engageable with the engaged portion of the guide unit, and a contact portion arranged between the pivot portion and the pressed portion and capable of coming into contact with the guide surface of the guide unit. The contact portion has a first contact portion arranged at a first distance from the pivot portion and configured to come into contact with the guide surface with the hook of the lever member in the first posture engaged with the engaged portion and the image forming unit locked at the first position. The first distance of the first contact portion is set such that, when the pressed portion of the lever member is pressed with the image forming unit locked at the first position, the lever member rotates about the pivot portion, the hook and the engaged portion are disengaged, the image forming unit is pushed upwardly against the biasing force of the first biasing member with the first contact portion serving as a pivot and the pivot portion serving as a weight point, and the positioning of the image forming unit by the positioning mechanism is released.

DETAILED DESCRIPTION

Figure 1:
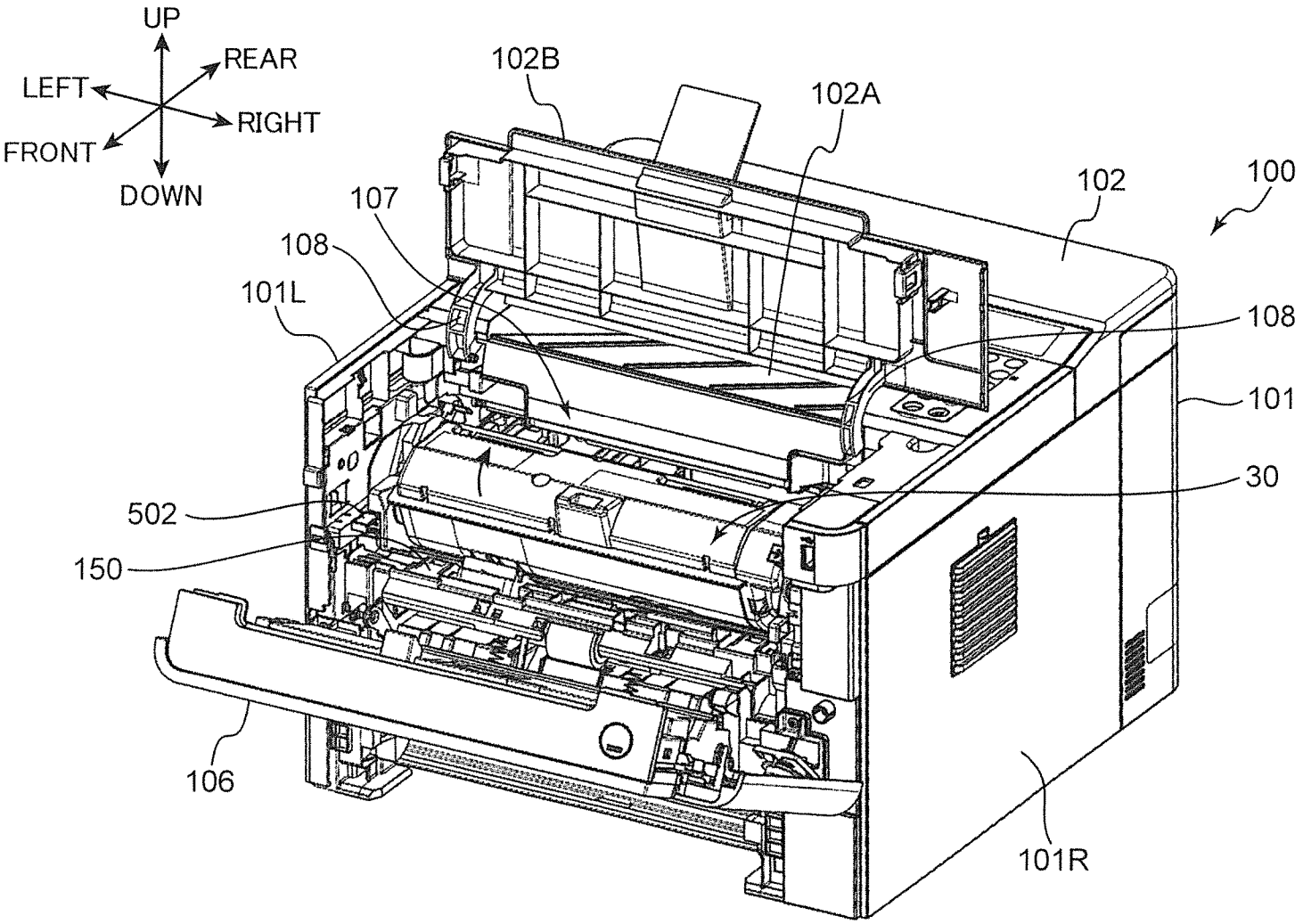
FIG. 1 is a perspective view showing an image forming apparatus according to one embodiment of the present disclosure.
Figure 2:
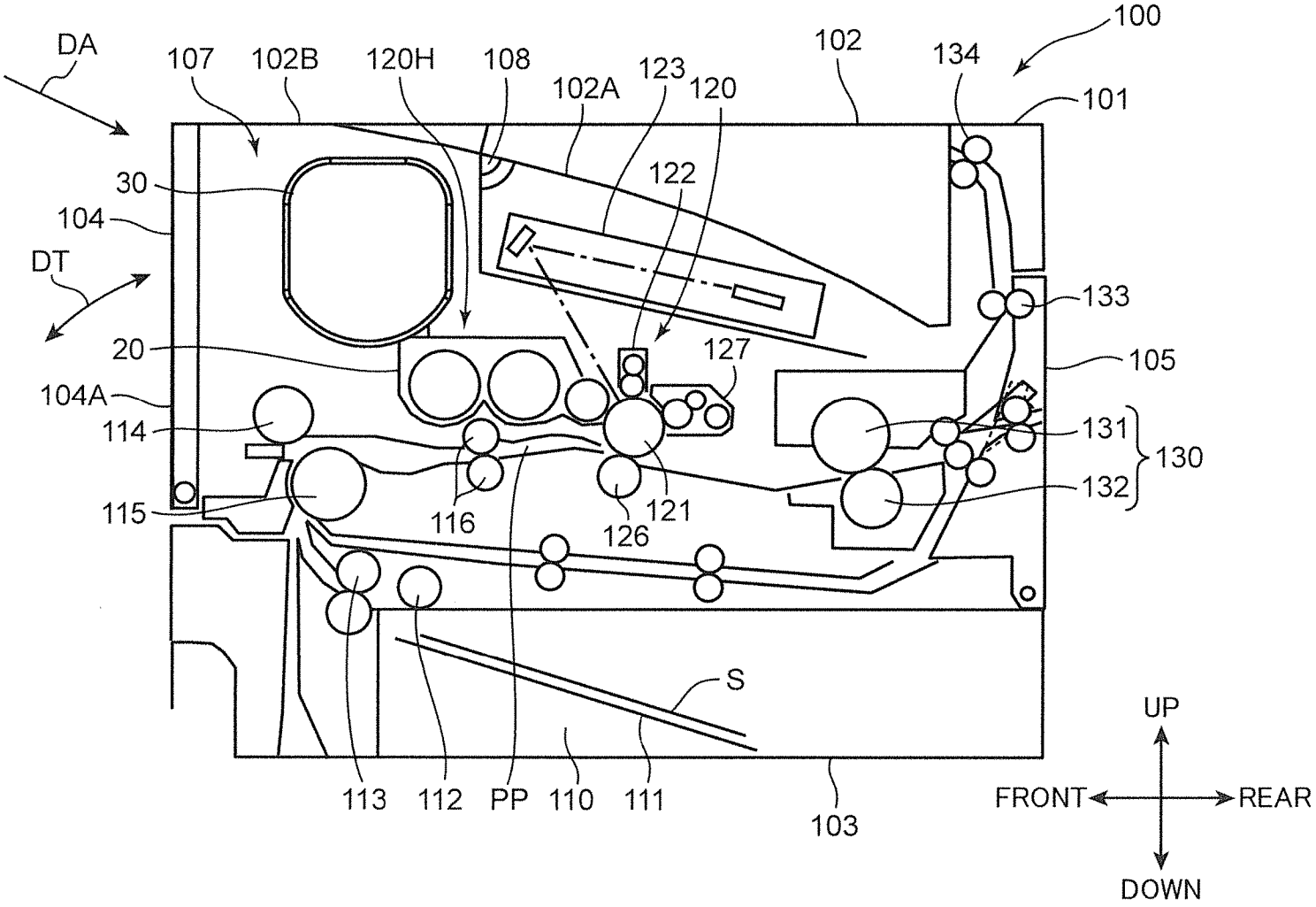
FIG. 2 is an internal sectional view of the image forming apparatus according to the one embodiment of the present disclosure.

Hereinafter, one embodiment of the present disclosure is described with reference to the drawings. FIG. 1 is a perspective view showing a printer 100 (image forming apparatus) according to this embodiment. FIG. 2 is a sectional view schematically showing an internal structure of the printer 100. The printer 100 shown in FIGS. 1 and 2 is a so-called monochrome printer. However, in another embodiment, the image forming apparatus may be a color printer, a facsimile machine, a complex machine provided with these functions or another apparatus for forming a toner image on a sheet. Note that direction-indicating terms such as "upper" and "lower", "front" and "rear", "left" and "right" used in the following description are merely for the purpose of clarifying the description and do not limit the principle of the image forming apparatus at all.

The printer 100 includes a housing 101 (apparatus body) for housing various devices for forming an image on a sheet S. The housing 101 includes an upper wall 102 defining the upper surface of the housing 101, a bottom wall 103 defining the bottom surface of the housing 101, a body rear wall 105 between the upper wall 102 and the bottom wall 103 and a body front wall 104 located in front of the body rear wall 105. The housing 101 has a body internal space 107 in which various devices are arranged. A sheet conveyance path PP along which a sheet S is conveyed in a predetermined conveying direction extends in the body internal space 107 of the housing 101. Further, the housing 101 includes a pair of left and right walls 101L, 101R (FIG. 1). The left and right walls 101L, 101R are wall parts forming the left and right side surfaces of the housing 101.

A sheet discharge portion 102A is arranged in a central part of the upper wall 102. The sheet discharge portion 102A is formed of an inclined surface inclined downwardly from a front part to a rear part of the upper wall 102. A sheet S having an image formed thereon in an image forming station 120 to be described later is discharged to the sheet discharge portion 102A. Further, a front cover 106 including a manual feed tray 104A is arranged at the body front wall 104. The front cover 106 is vertically rotatable about a lower end (arrow DT of FIG. 2). On the other hand, a front end part 102B of the upper wall 102 is rotatable rearwardly about an arm 108 (FIG. 1). When the front end part 102B of the upper wall 102 and the front cover 106 are respectively opened as shown in FIG. 1, the body internal space 107 is exposed to the outside of the printer 100. As a result, an image forming unit 120H to be described later is mountable into the housing 101. Further, a sheet S can be removed when being jammed in the sheet conveyance path PP.

With reference to FIG. 2, the printer 100 includes a cassette 110, a pickup roller 112, a first feed roller 113, a second feed roller 114, a conveyor roller 115, a pair of registration rollers 116, the image forming station 120 and a fixing device 130.

The cassette 110 stores sheets S inside. The cassette 110 includes a lift plate 111. The lift plate 111 is inclined to push up the leading end edges of the sheets S. The cassette 110 can be pulled out forward with respect to the housing 101.

The pickup roller 112 is arranged above the leading end edges of the sheets S pushed up by the lift plate 111. When the pickup roller 112 rotates, the sheet S is pulled out from the cassette 110. The first feed roller 113 is arranged downstream of the pickup roller 112 and feeds the sheet S to a further downstream side. The second feed roller 114 is arranged inwardly (rearwardly) of a pivot point of the manual feed tray 104A and pulls a sheet S on the manual feed tray 104A into the housing 101.

The conveyor roller 115 is disposed downstream (hereinafter, also merely referred to as downstream without reference to the sheet conveying direction) of the first feed roller 113 and the second feed roller 114 in a sheet conveying direction (hereinafter, also merely referred as to a conveying direction). The conveyor roller 115 conveys the sheet S fed by the first and second feed rollers 113, 114 to a further downstream side.

The pair of registration rollers 116 function to correct the oblique feed of the sheet S. In this way, the position of an image to be formed on the sheet S is adjusted. The pair of registration rollers 116 supply the sheet S to the image forming station 120 in accordance with an image formation timing by the image forming station 120.

The image forming station 120 includes a photoconductive drum 121 (image carrier), a charger 122, an exposure device 123, a developing device 20, a toner container 30 (developer storage container), a transfer roller 126 and a cleaning device 127. Note that, as described later, the developing device 20 and the toner container 30 are, as the image forming unit 120H, integrally mountable into and removable from the housing 101.

The photoconductive drum 121 has a cylindrical shape and is rotatably supported in the housing 101. The photoconductive drum 121 has a peripheral surface, on which an electrostatic latent image is to be formed, and carries a toner image (developer image) corresponding to the electrostatic latent image on the peripheral surface. The charger 122 has a predetermined voltage applied thereto and substantially uniformly charges the peripheral surface of the photoconductive drum 121.

The exposure device 123 irradiates laser light to the peripheral surface of the photoconductive drum 121 charged by the charger 122. This laser light is irradiated in accordance with image data output from an external apparatus (not shown) such as a personal computer communicably connected to the printer 100. As a result, an electrostatic latent image corresponding to the image data is formed on the peripheral surface of the photoconductive drum 121.

The developing device 20 supplies toner (developer) to the peripheral surface of the photoconductive drum 121 having an electrostatic latent image formed thereon. The toner container 30 supplies the toner to the developing device 20. The toner container 30 is disposed to be detachably attachable to the developing device 20. When the developing device 20 supplies the toner to the photoconductive drum 121, an electrostatic latent image formed on the peripheral surface of the photoconductive drum 121 is developed (visualized). As a result, a toner image (developer image) is formed on the peripheral surface of the photoconductive drum 121.

The transfer roller 126 is arranged below the photoconductive drum 121 to face the photoconductive drum 121 across the sheet conveyance path PP. A transfer nip portion is formed between the transfer roller 126 and the photoconductive drum 121, and the transfer roller 126 transfers the toner image to the sheet S.

The cleaning device 127 removes the toner remaining on the peripheral surface of the photoconductive drum 121 after the toner image is transferred to the sheet S.

The fixing device 130 is arranged downstream of the image forming station 120 in the conveying direction and fixes the toner image on the sheet S. The fixing device 130 includes a heating roller 131 for melting the toner on the sheet S and a pressure roller 132 for bringing the sheet S into close contact with the heating roller 131.

The printer 100 further includes a pair of conveyor rollers 133 disposed downstream of the fixing device 130 and a pair of discharge rollers 134 disposed downstream of the pair of conveyor rollers 133. The sheet S is conveyed upwardly by the pair of conveyor rollers 133 and finally discharged from the housing 101 by the pair of discharge rollers 134. The sheet S discharged from the housing 101 is stacked on the sheet discharge portion 102A.

Figure 3:
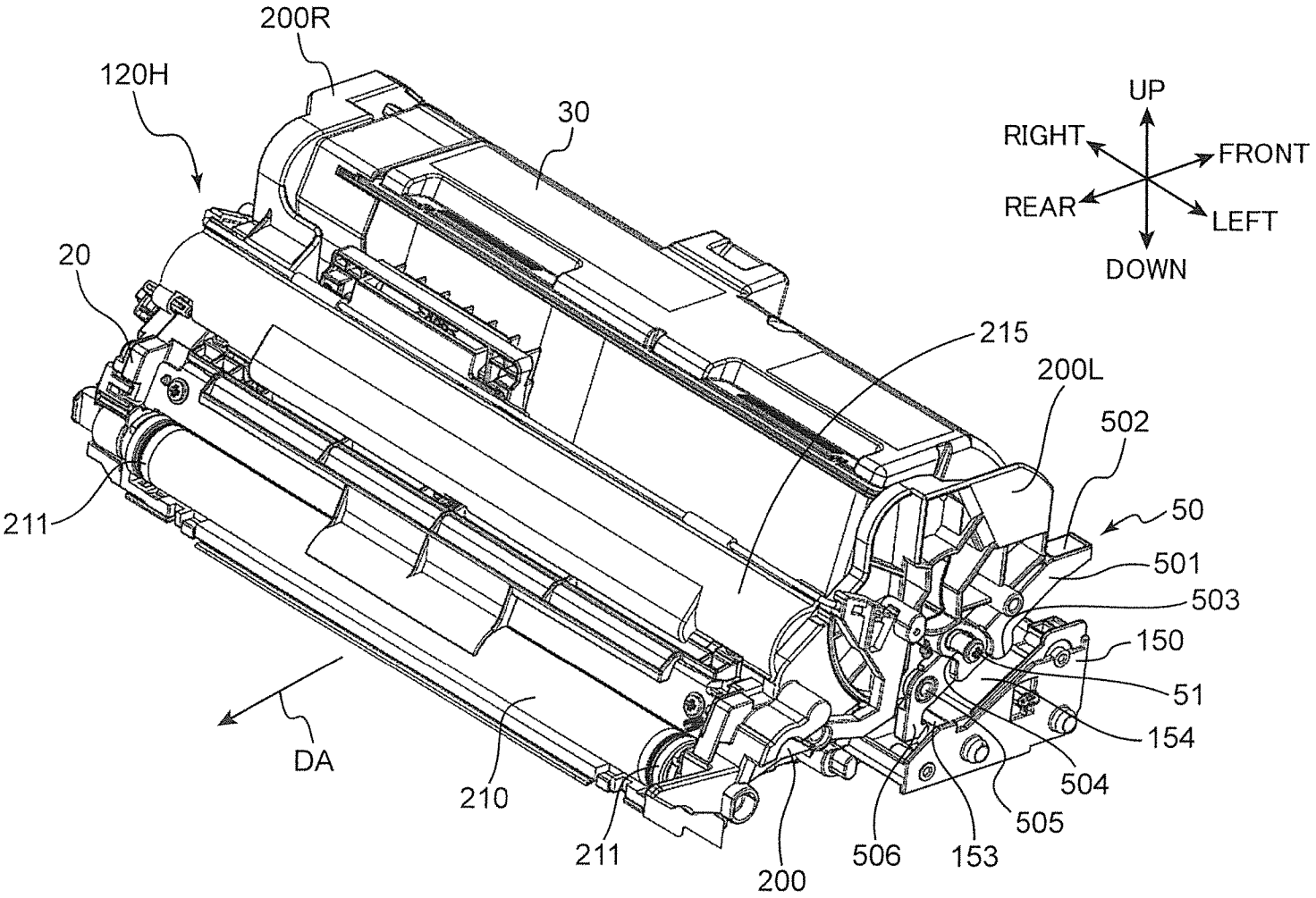
FIG. 3 is a perspective view of an image forming unit and a guide unit according to the one embodiment of the present disclosure.
Figure 4:
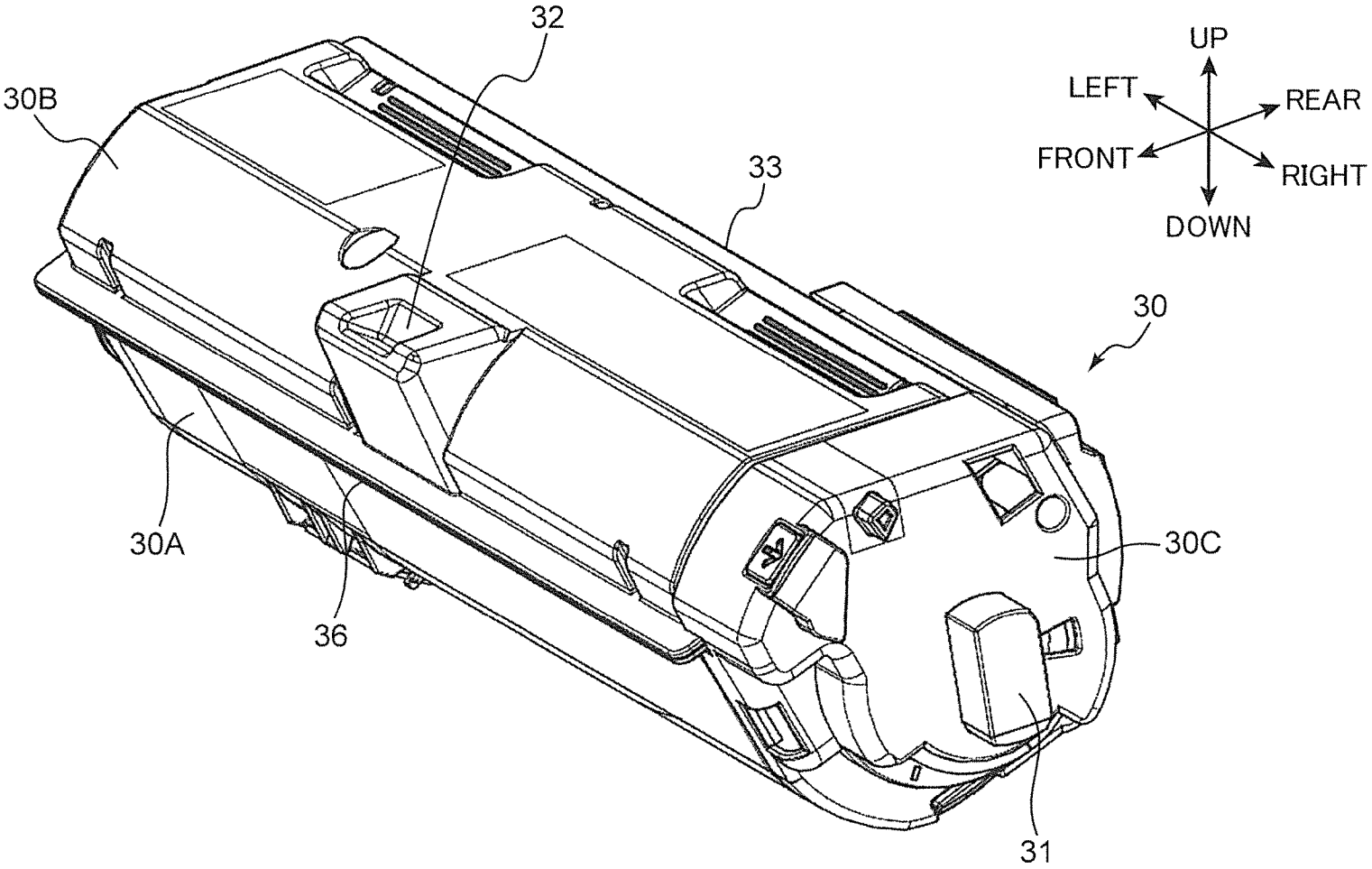
FIG. 4 is a perspective view of a developer storage container according to the one embodiment of the present disclosure.
Figure 5:
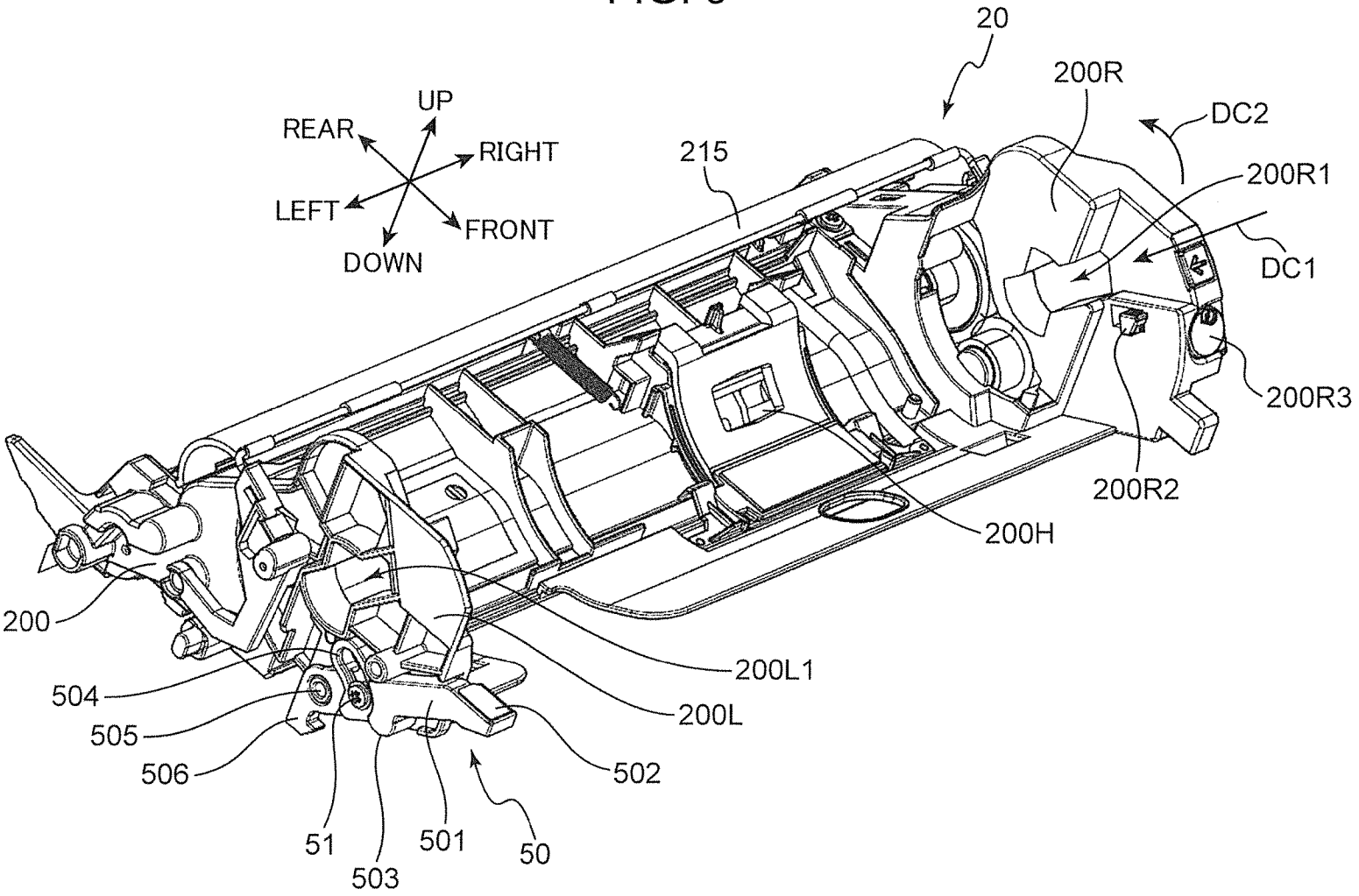
FIG. 5 is a perspective view of a developing device according to the one embodiment of the present disclosure.
Figure 6:
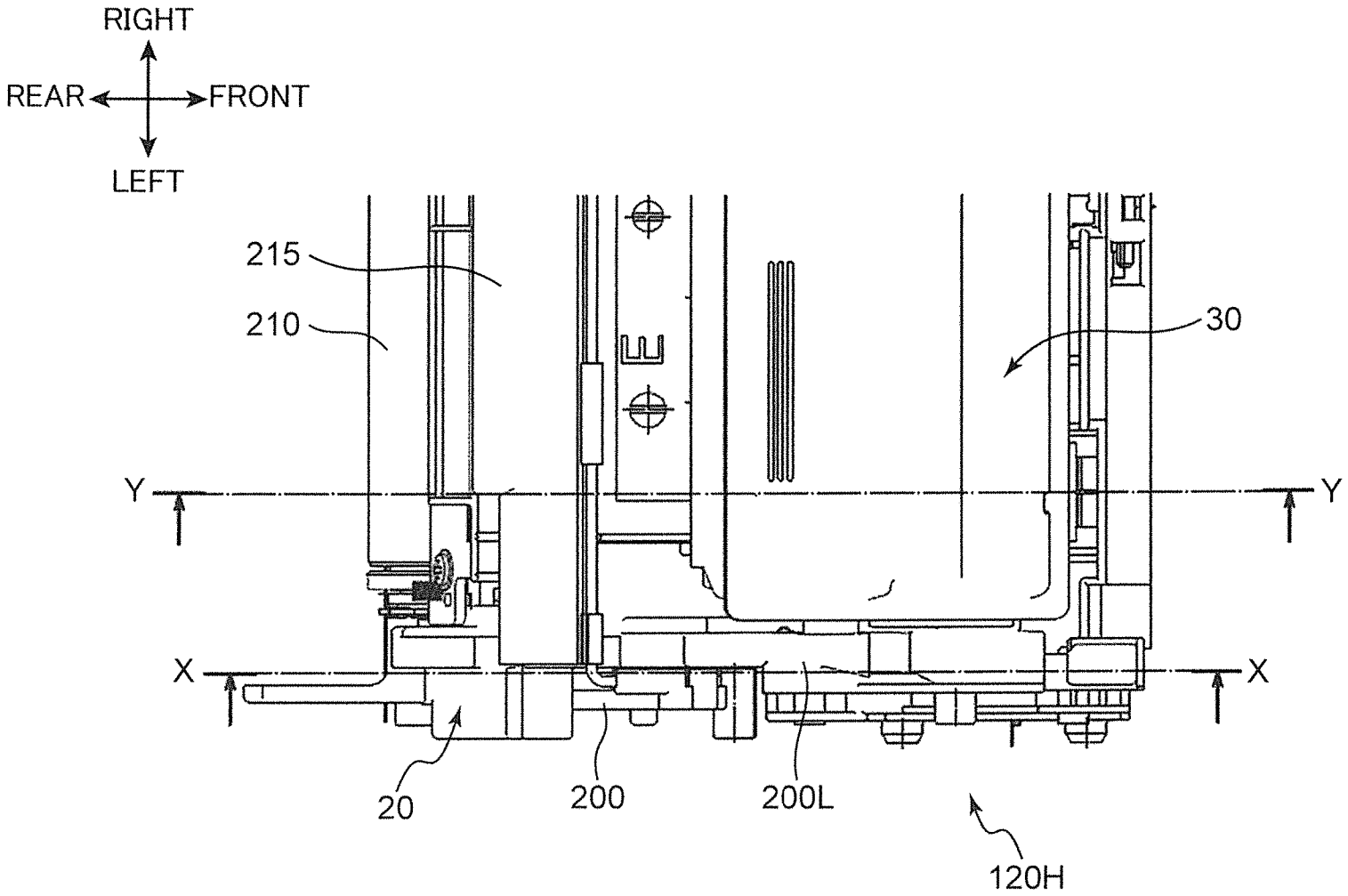
FIG. 6 is a top view of a part of the image forming unit according to the one embodiment of the present disclosure.

Next, the image forming unit 120H (developing device 20 and toner container 30) according to this embodiment is described in detail with reference to FIGS. 3 to 11. FIG. 3 is a perspective view of the image forming unit 120H and a later-described body unit 150 (guide unit) according to this embodiment. FIG. 4 is a perspective view of the toner container 30 according to this embodiment. FIG. 5 is a perspective view of the developing device 20 according to this embodiment. FIG. 6 is a top view of a part of the image forming unit 120H.

Figure 7:
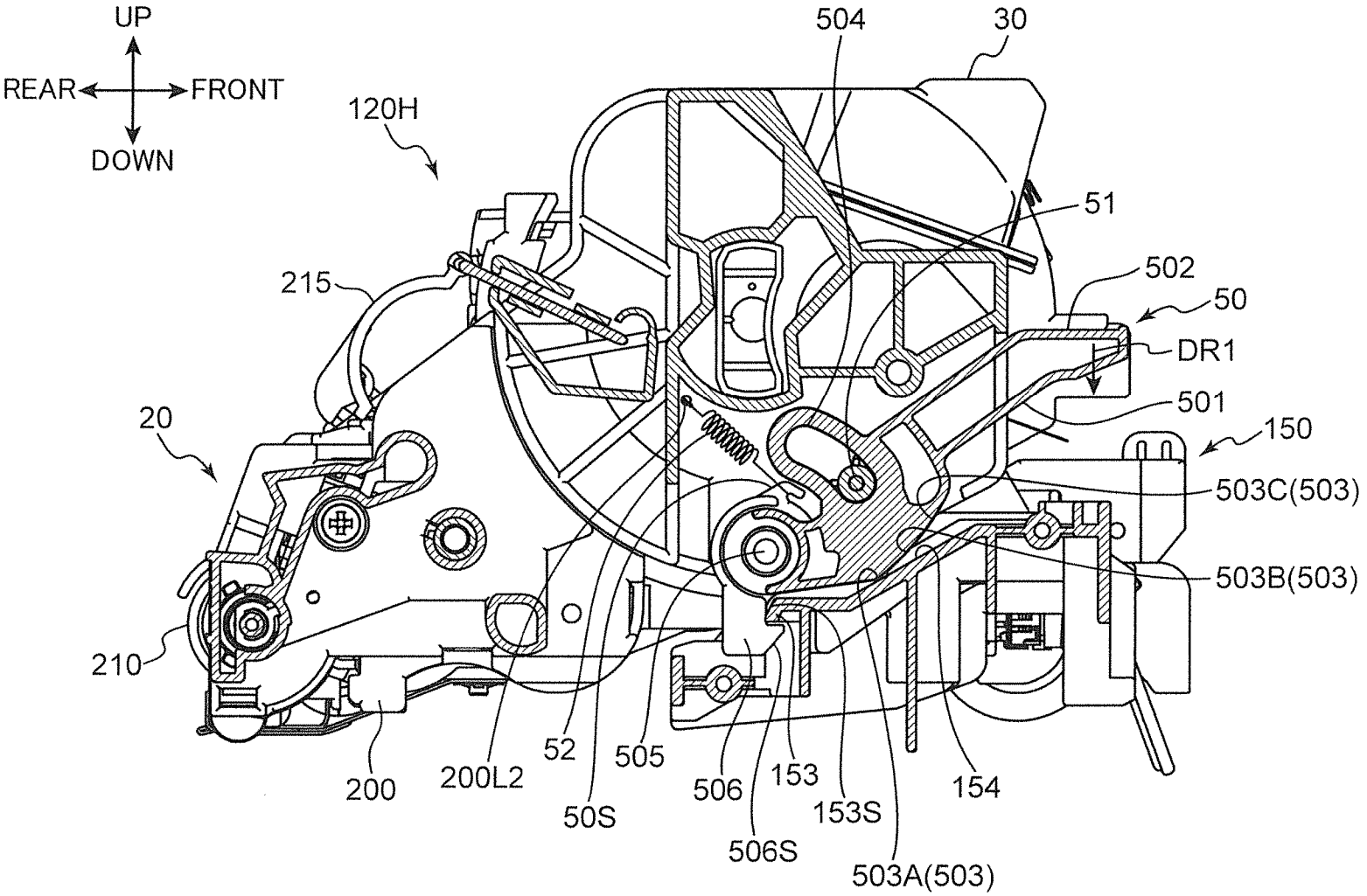
FIG. 7 is a sectional view of the image forming unit and the guide unit according to the one embodiment of the present disclosure showing a state where a lever member is pressed.
Figure 8:
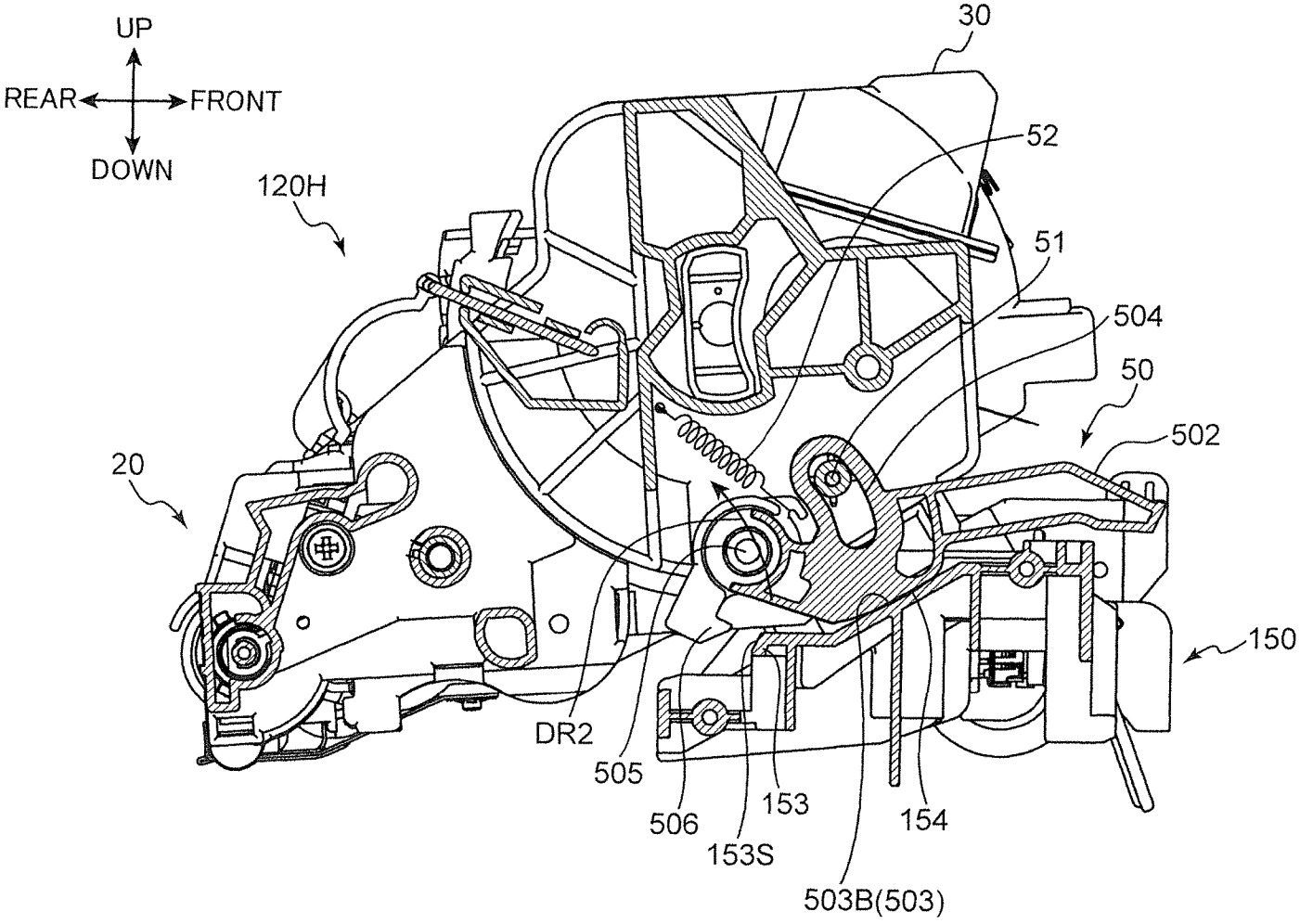
FIG. 8 is a sectional view of the image forming unit and the guide unit according to the one embodiment of the present disclosure showing the state where the lever member is pressed.
Figure 9:
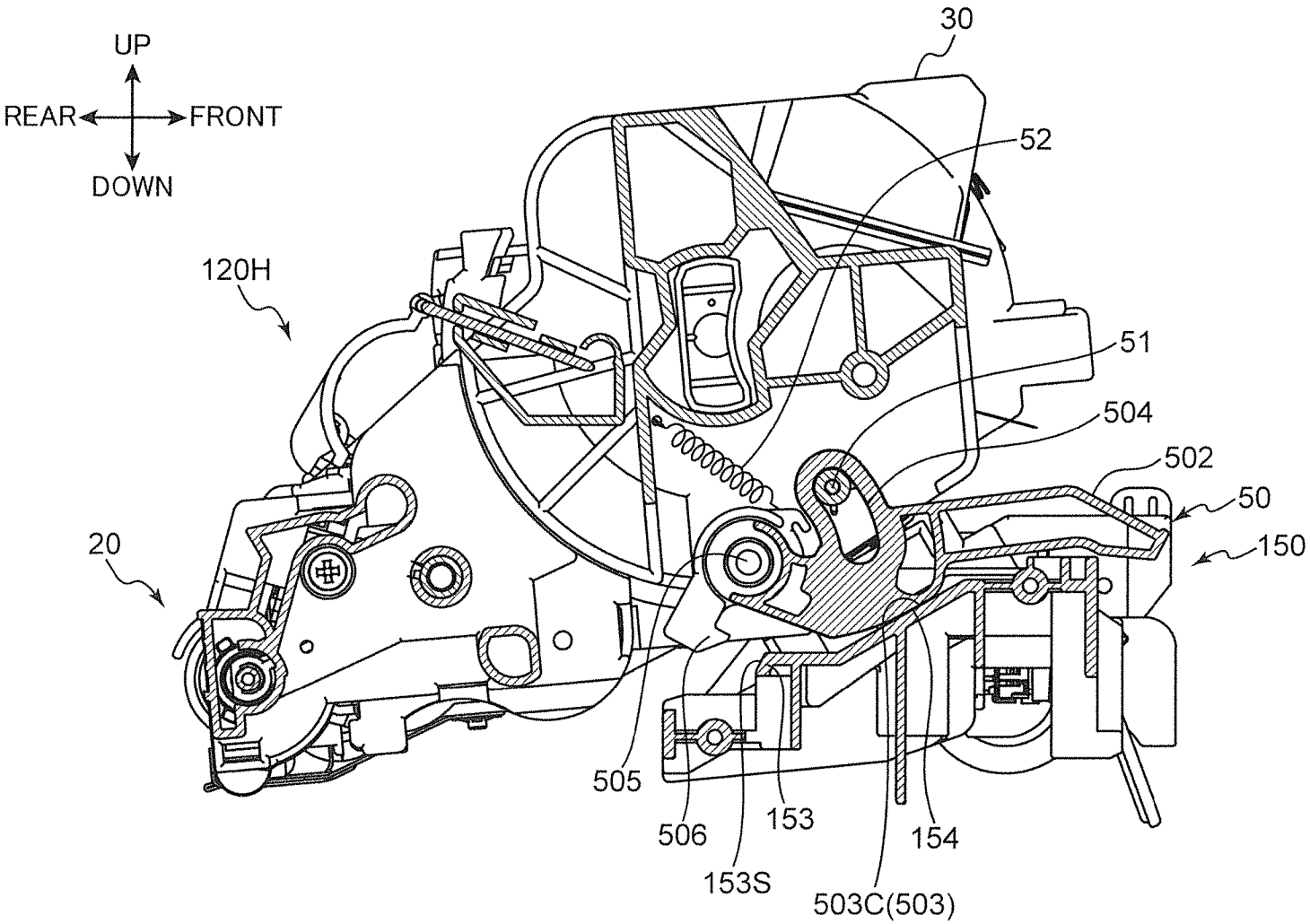
FIG. 9 is a sectional view of the image forming unit and the guide unit according to the one embodiment of the present disclosure showing the state where the lever member is pressed.
Figure 10:
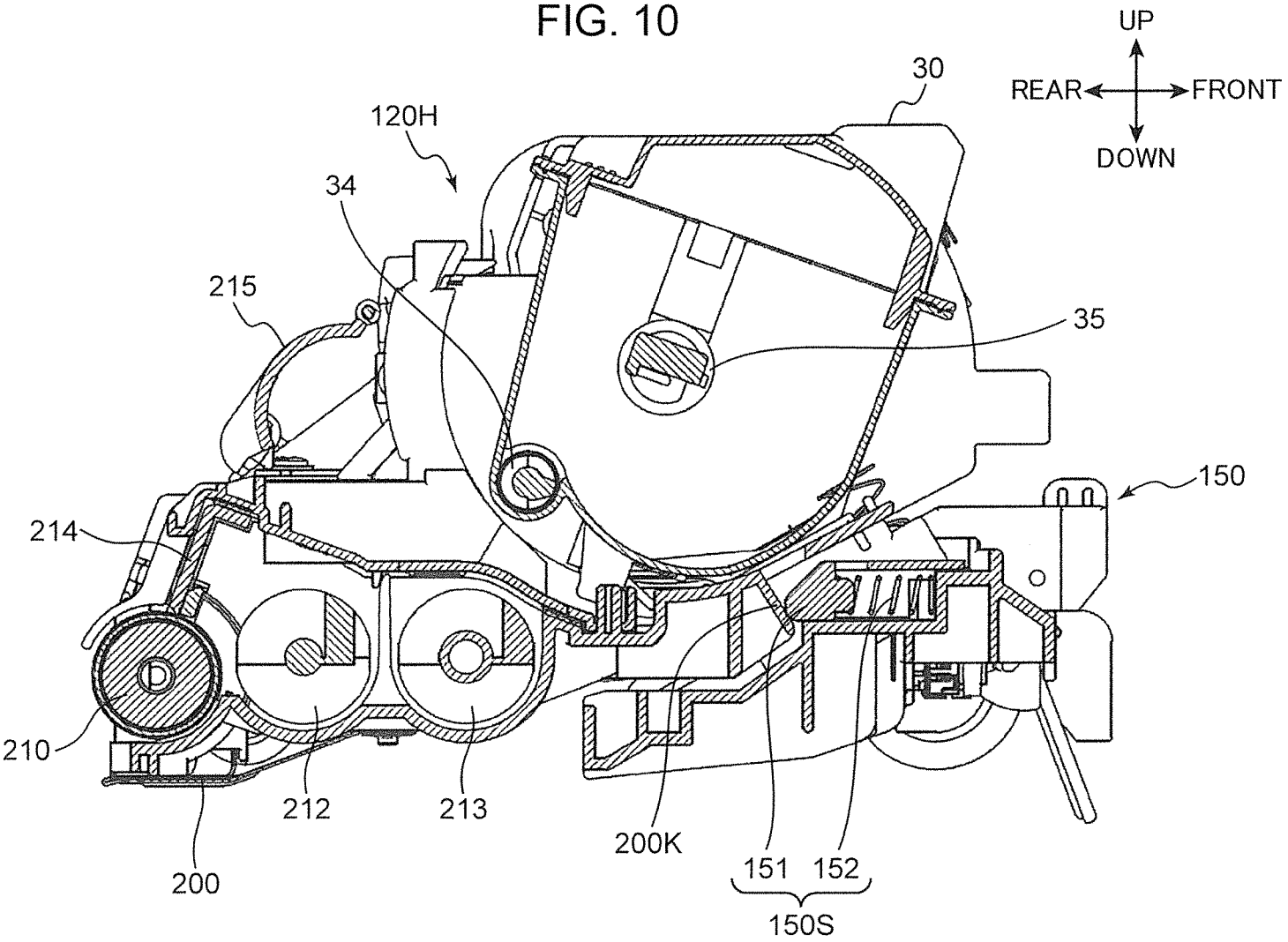
FIG. 10 is a sectional view of the image forming unit and the guide unit according to the one embodiment of the present disclosure showing a state where the image forming unit is positioned by a positioning mechanism.
Figure 11:
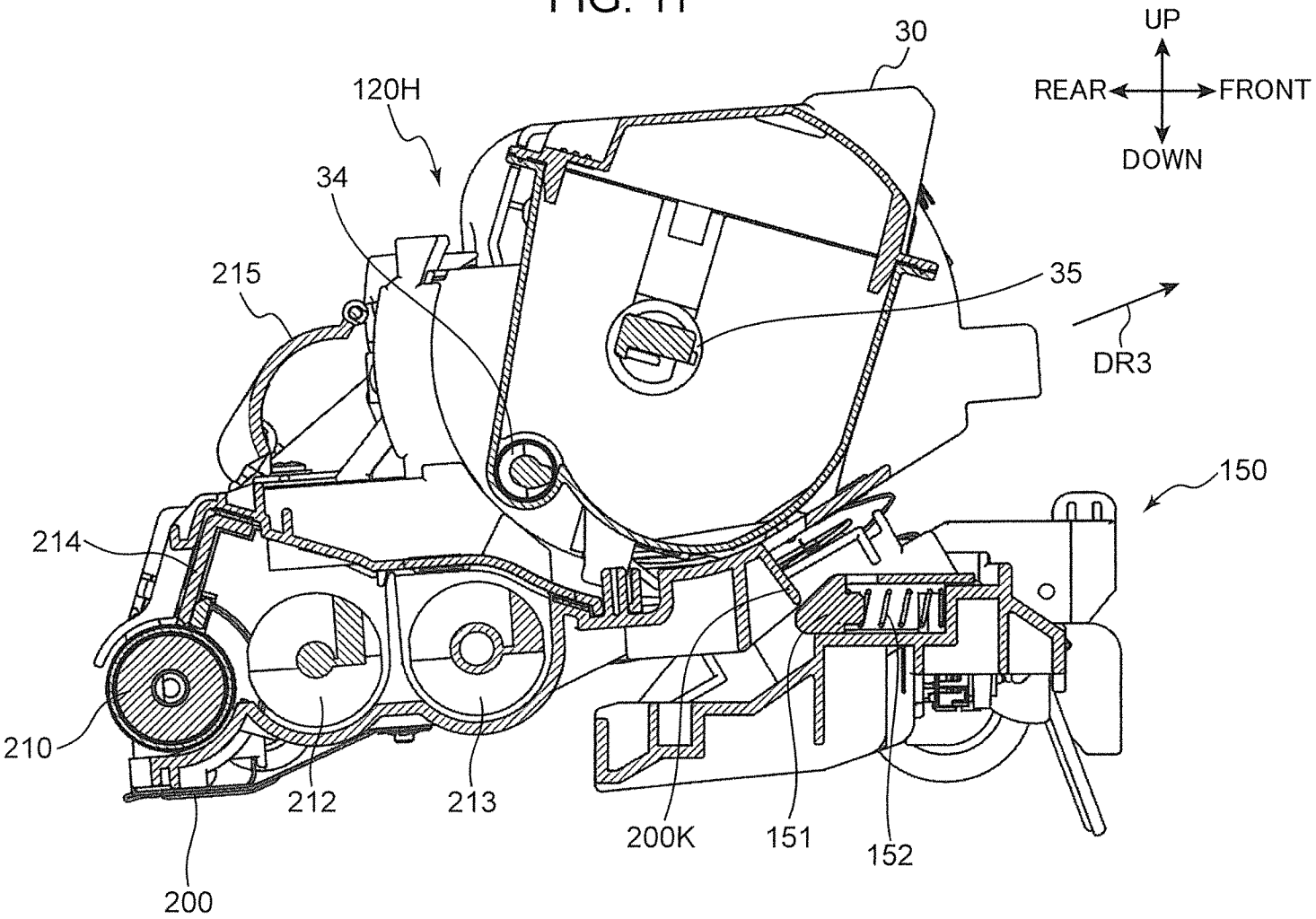
FIG. 11 is a sectional view of the image forming unit and the guide unit according to the one embodiment of the present disclosure showing a state where the positioning of the image forming unit by the positioning mechanism is released.

Further, FIGS. 7 to 9 are sectional views of the image forming unit 120H and the body unit 150 showing a state where a lock lever 50 to be described later is pressed. Further, FIGS. 10 and 11 are sectional views of the image forming unit 120H and the body unit 150 according to this embodiment, wherein FIG. 10 is a view showing a state where the image forming unit 120H is positioned by a positioning mechanism 150S and FIG. 11 is a view showing a state where the positioning of the image forming unit 120H by the positioning mechanism 150S is released. Note that each of the sectional views of FIGS. 7 to 9 corresponds to a sectional view along line X-X of FIG. 6, and each of the sectional views of FIGS. 10 and 11 corresponds to a sectional view along line Y-Y of FIG. 6.

As described above, the image forming unit 120H (FIG. 3) includes the developing device 20 and the toner container 30. The image forming unit 120H is mountable into and removable from the housing 101 in predetermined mounting and removing directions. As a result, the toner container 30 can be mounted into the housing 101 integrally with the developing device 20. Note that, when the developing device 20 is already mounted in the housing 101, the toner container 30 can also be singly attached to the developing device 20 in the housing 101. An arrow DA of FIGS. 2 and 3 indicates the mounting direction of the image forming unit 120H into the housing 101.

Further, the printer 100 includes the body unit 150 (guide unit) (FIGS. 3 and 7). The body unit 150 is arranged in the housing 101 and guides the mounting and removal of the image forming unit 120H. When the front cover 106 is opened with respect to the housing 101 as shown in FIG. 1, the body unit 150 is exposed to the outside of the housing 101. The image forming unit 120H is mounted into the body internal space 107 of the housing 101 to pass above the body unit 150. As shown in FIG. 3, the body unit 150 is a unit having a substantially triangular shape in a side view and extending long in a lateral direction. The body unit 150 includes the positioning mechanisms 150S (FIG. 10), an engaged portion 153 (FIGS. 3 and 7) and a guide surface 154 (FIG. 7).

A pair of the positioning mechanisms 150S are arranged on both lateral end parts of the body unit 150. The positioning mechanism 150S includes a biasing projection 151 (unit contact portion) and a unit biasing spring 152 (first biasing member). The biasing projection 151 comes into contact with a housing pressed portion 200K (FIG. 10) of the image forming unit 120H mounted in the housing 101. As shown in FIG. 10, the biasing projection 151 includes a tip part tapered in the mounting direction of the image forming unit 120H into the housing 101. The unit biasing spring 152 biases the biasing projection 151 rearwardly. In other words, the unit biasing spring 152 positions the image forming unit 120H by biasing the image forming unit 120H mounted at a later-described first position in the housing 10 rearwardly.

The guide surface 154 (FIG. 7) is formed on an upper surface part of the body unit 150. The guide surface 154 has a function of guiding the mounting of the image forming unit 120H. The guide surface 154 has an inclined surface inclined downwardly from front to rear. Further, a rear end side of the guide surface 154 behind this inclined surface is a horizontal surface. The engaged portion 153 is arranged more forward than the guide surface 154 in the mounting direction (direction of the arrow DA of FIG. 3) of the image forming unit 120H. A hook 506 (FIG. 7) of the later-described lock lever 50 is engageable with the engaged portion 153.

With reference to FIG. 4, the toner container 30 stores the toner (developer) inside. The toner container 30 includes a container body 30A, a container lid portion 30B and a container cover 30C. The container body 30A is shaped to extend in the lateral direction (longitudinal direction). Note that an upper surface part of the container body 30A is open.

The container lid portion 30B is fixed to the container body 30A to close an opening of the container body 30A. In this embodiment, the container lid portion 30B is welded and fixed to the container body 30A. The container lid portion 30B includes a first grip portion 32, a second grip portion 33 and a third grip portion 36. In attaching the toner container 30 to the developing device 20 or in mounting the image forming unit 120 including the toner container 30 and the developing device 20 into the housing 101, an operator can grip the first and second grip portions 32, 33 or the first and third grip portions 32, 36.

The container cover 30C is mounted on a right side part of the container body 30A. The container cover 30C includes a container guide 31. The container guide 31 is a guide having a substantially rectangular parallelepiped shape and projecting from the container cover 30C. Note that, although not shown in FIG. 4, a guide having the same shape as the container guide 31 is provided on a left side part of the toner container 30. These guides guide the attachment of the toner container 30 to the developing device 20.

Further, the toner container 30 includes a conveying screw 34 and a stirring paddle 35 (FIG. 10).

The conveying screw 34 is a screw arranged along a bottom part of the container body 30A. An unillustrated toner discharge port is open in the bottom part of the container body 30A. The conveying screw 34 is rotated to convey the toner in the container body 30A toward the toner discharge port. When an unillustrated shutter provided in the container body 30A is slid, the toner discharge port is open and the toner can be discharged from the toner container 30. The stirring paddle 35 is rotatably supported in the toner container 30 and stirs the toner stored in the toner container 30.

The developing device 20 includes a development housing 200 (FIG. 3), a developing roller 210 (FIGS. 3 and 10), contact rollers 211 (FIG. 3) (interval holding members), a first screw 212 (FIG. 10), a second screw 213 (FIG. 10), a layer thickness restricting member 214 (FIG. 10) and a developing roller cover 215.

The development housing 200 is a housing for supporting each member of the developing device 20. Further, the development housing 200 has a function of supporting the toner container 30. With reference to FIG. 5, the development housing 200 includes a housing left wall 200L, a housing right wall 200R and a toner supply port 200H. The housing left wall 200L and the housing right wall 200R are wall parts rising from both lateral end parts of the development housing 200. The toner container 30 is attached between the housing left wall 200L and the housing right wall 200R. Further, the development housing 200 includes the housing pressed portion 200K (FIG. 10). The housing pressed portion 200K is pressed by the biasing projections 151 of the positioning mechanisms 150S.

The housing right wall 200R includes a right guide portion 200R1, a lock piece 200R2 and a press button 200R3. The housing left wall 200L includes a left guide portion 200L1. The right and left guide portions 200R1, 200L1 are respectively guide grooves formed in the housing right wall 200R and the housing left wall 200L. These guide portions are formed along an attaching direction (arrow DC1 of FIG. 5) of the toner container 30 to the development housing 200. The aforementioned container guide 31 (FIG. 4) of the toner container 30 is inserted into the right guide portion 200R. Further, the unillustrated guide provided on the left side surface of the toner container 30 is inserted into the left guide portion 200L1. Note that the toner container 30 is rotated in a direction of an arrow DC2 of FIG. 5 after being inserted into an upper part of the development housing 200. As a result, the unillustrated toner discharge port of the toner container 30 faces the toner supply port 200H and the toner can be supplied from the toner container 30 to the developing device 20. The lock piece 200R2 locks the toner container 30 rotated in the direction of the arrow DC2. Further, when the press button 200R3 is pressed, the locking of the toner container 30 is released and the toner container 30 is rotated in a direction opposite to the direction of the arrow DC2 of FIG. 5. As a result, the toner container 30 is detachable from the developing device 20 along a direction opposite to the direction of the arrow DC1.

The developing roller 210 is rotatably supported in the development housing 200. The developing roller 210 carries the developer composed of the toner and carrier on a peripheral surface. The developing roller 210 supplies the toner to the photoconductive drum 121 to develop an electrostatic latent image on the photoconductive drum 121. A pair of the contact rollers 211 are arranged on both axial end parts of the developing roller 210. The contact rollers 211 hold an interval between the developing roller 210 and the photoconductive drum 121 constant by being held in contact with the peripheral surface of the photoconductive drum 121. The first and second screws 212, 213 are screws rotatably supported in the development housing 200. The developer in the development housing 200 is conveyed in a circulating manner by the first and second screws 212, 213. Further, the developer is supplied to the developing roller 210 by the first screw 212. The layer thickness restricting member 214 restricts a layer thickness of the developer supplied onto the developing roller 210. The developing roller cover 215 is pivotable with respect to the development housing 200. FIG. 3 shows a state where the developing roller cover 215 is retracted upwardly of the developing roller 210. When being pivoted downwardly from the state shown in FIG. 3, the developing roller cover 215 can cover the developing roller 210. Thus, the adhesion of foreign matters to the developing roller 210 and the smear of surroundings by the toner on the developing roller 210 are suppressed when the image forming unit 120H is removed from the housing 101.

Further, the developing device 20 includes the lock lever 50 (lever member) (FIGS. 3 and 5). The lock lever 50 is pivotably provided on the housing left wall 200L of the developing device 20. The lock lever 50 can change the posture thereof between a first posture for locking the image forming unit 120H (developing device 20) at a first position to be described later in the housing 101 and a second posture for unlocking the image forming unit 120H and allowing the image forming unit 120 to be removed from the housing 101 along the predetermined removing direction.

With reference to FIGS. 3, 5 and 7, the lock lever 50 includes an arm portion 501, a lever pressed portion 502 (pressed portion), a contact portion 503, a guide groove 504 and a pivot portion 505, and the hook 506. The arm portion 501 is a body part of the lock lever 50 and arranged to obliquely extend from a front-upper side toward a rear-lower side as shown in FIG. 7. The lever pressed portion 502 is a flat portion provided on an upper end part of the arm portion 501. The lever pressed portion 502 is pressed by an operator when the image forming unit 120H is removed from the housing 101.

The contact portion 503 is arranged substantially in a central part of the lock lever 50 in a front-rear direction of the lock lever 50 and has an arc shape projecting downward when viewed in a cross-section perpendicular to the lateral direction (axial center direction of the pivot portion 505) as shown in FIG. 7. Note that, when the image forming unit 120H is mounted into the housing 101, the contact portion 503 is arranged to face the guide surface 154 of the body unit 150 as shown in FIGS. 3 and 7 and can come into contact with the guide surface 154.

The contact portion 503 (FIG. 7) has a first contact portion 503A, a second contact portion 503B and a third contact portion 503C. The first, second and third contact portions 503A, 503B and 503C are coupled by an arc of the contact portion 503.

The first contact portion 503A is arranged at a first distance from the pivot portion 505 and comes into contact with the guide surface 154 with the hook 506 of the lock lever 50 in the later-described first posture of the image forming unit 120H engaged with the engaged portion 153 (FIG. 7) and the image forming unit 120H locked at the first position. Further, the second contact portion 503B is arranged at a second distance longer than the first distance from the pivot portion 505 on a side closer to the lever pressed portion 502 than the first contact portion 503A. The second contact portion 503B can come into contact with the guide surface 154 and is spaced from the guide surface 154 with the image forming unit 120H locked at the first position. The third contact portion 503C is arranged at a third distance longer than the second distance from the pivot portion 505 on a side closer to the lever pressed portion 502 than the second contact portion 503B. The third contact portion 503C can come into contact with the guide surface 154 and is spaced from the guide surface 154 with the image forming unit 120H locked at the first position.

The guide groove 504 is a groove portion open rearwardly of the contact portion 503. The guide groove 504 is open to have an arc shape centered on the pivot portion 505. Note that a lever-side locking portion 50S is provided at an inner side of the guide groove 504 (on the side of the pivot portion 505). The lever-side locking portion 50S has a hook shape projecting from the lock lever 50. One end of a lever biasing spring 52 to be described later is locked to the lever-side locking portion 50.

The pivot portion 505 is arranged on a rear end side of the lock lever 50. The pivot portion 505 is rotatably supported on the housing left wall 200L of the development housing 200. Thus, the lock lever 50 is coupled to the housing left wall 200L via the pivot portion 505. The pivot portion 505 serves as a pivot in the pivotal movement of the lock lever 50. Note that the aforementioned contact portion 503 is arranged between the pivot portion 505 and the lever pressed portion 502 (FIG. 7).

The hook 506 is arranged on a side opposite to the lever pressed portion 502 across the pivot portion 505. The hook 506 is engageable with the engaged portion 153 (FIG. 7) of the body unit 150. As shown in FIG. 7, the hook 506 extends downward from the pivot portion 505 and a tip part thereof is bent forwardly (toward a rear end side in the mounting direction of the image forming unit 120H). Note that the hook 506 is rotatable about the pivot portion 505 as described in detail later. Further, the developing device 20 includes a guide screw 51 and the lever biasing spring 52 (second biasing member) (FIG. 7). The guide screw 51 is a screw inserted through the guide groove 504 and fastened to the housing left wall 200L. The guide screw 51 has a function of guiding the pivotal movement of the lock lever 50 along the guide groove 504.

The lever biasing spring 52 is a spring member which expands and contracts between the housing left wall 200L of the development housing 200 and the lock lever 50. The aforementioned housing left wall 200L includes a housing-side locking portion 200L2. As shown in FIG. 7, one end of the lever biasing spring 52 is locked to the lever-side locking portion 50S of the lock lever 50 and the other end of the lever biasing spring 52 is locked to the housing-side locking portion 200L2. As a result, the lever biasing spring 52 biases the lock lever 50 about the pivot portion 505 such that the hook 506 engages the engaged portion 153 (FIG. 7) (the lock lever 50 is set in the first posture to be described later).

Next, the mounting and removal of the image forming unit 120H into and from the housing 101 are described. Note that, as described above, the image forming unit 120H is composed of the developing device 20 and the toner container 30. The toner container 30 is attachable to and detachable from the developing device 20. Further, the image forming unit 120H including only the developing device 20 without including the toner container 30 can be mounted into the housing 101. Here, a state where the image forming unit 120H including the toner container 30 is mounted into and removed from the housing 101 is described.

When the front cover 106 and the front end part 102B of the upper wall 102 of the housing 101 are opened as shown in FIG. 1, the image forming unit 120H is mounted into the body internal space 107 of the housing 101. At this time, the image forming unit 120H is inserted into the body insertion space 107 along the direction of the arrow DA of FIGS. 2 and 3. The body unit 150 (FIG. 3) guides a lower part of the image forming unit 120H. When the image forming unit 120H is inserted, the hook 506 of the lock lever 50 moves rearward while sliding on the guide surface 154. Eventually, the inclined surface 506S (FIG. 7) of the hook 506 rubs against the inclined surface 153S of the engaged portion 153. At this time, the hook 506 slightly rotates clockwise about the pivot portion 505 in FIG. 7, whereby the tip part of the hook 506 slips under the engaged portion 153. As a result, the hook 506 is engaged with the engaged portion 153 and the image forming unit 120H is located at the first position shown in FIG. 7. The posture of the lock lever 50 in FIG. 7 is defined as the first posture. At this time, as shown in FIG. 10, the housing pressed portion 200K of the development housing 200 is pressed rearwardly by the biasing projections 151 of the positioning mechanisms 150S. Specifically, the positioning mechanisms 150S bias the image forming unit 120H in a direction to bring the developing roller 210 closer to the photoconductive drum 121. When the image forming unit 120H is positioned at the first position of FIGS. 7 and 10 in the housing 101, the contact rollers 211 (FIG. 3) come into contact with the peripheral surface of the photoconductive drum 121, whereby the developing roller 210 is stably arranged at a predetermined interval from the photoconductive drum 121. As a result, the toner is stably supplied from the developing roller 210 to the photoconductive drum 121 and a toner image is formed on the photoconductive drum 121.

In removing the image forming unit 120H from the housing 101, when the front cover 106 and the front end part 102B of the upper wall 102 of the housing 101 are opened as shown in FIG. 1, the lever pressed portion 502 of the lock lever 50 is exposed to the outside of the printer 100. The operator first presses the lever pressed portion 502 downwardly (arrow DR1 of FIG. 7). At this time, in this embodiment, the first contact portion 503A of the contact portion 503 is already in contact with the guide surface 154 (FIG. 7). In this case, since a load for the operator to press the lever pressed portion 502 is generated from an initial stage, the operator can press the lever pressed portion 502 while feeling this load.

Figure 19:
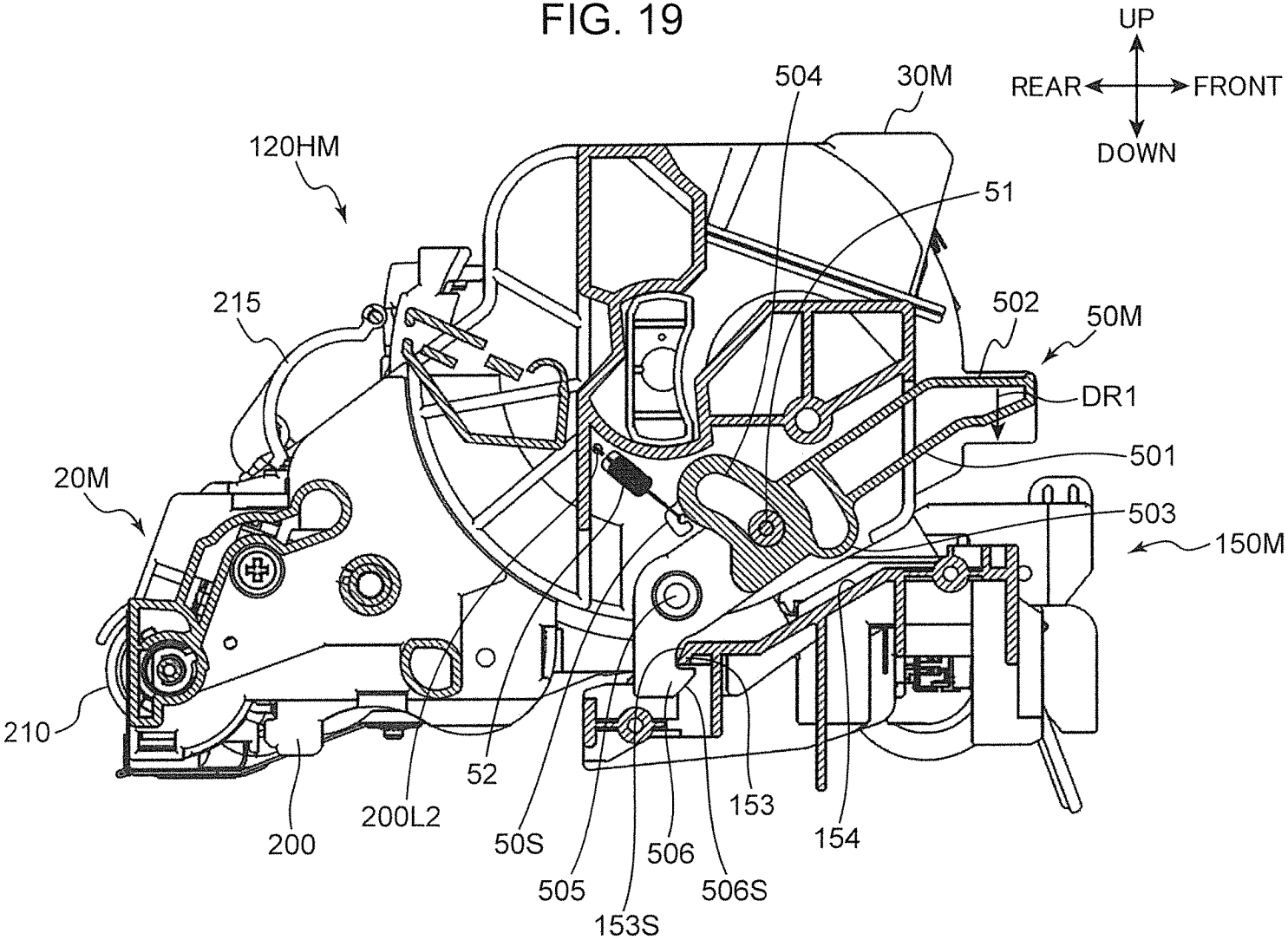
FIG. 19 is a sectional view of an image forming unit and a guide unit in another image forming apparatus to be compared with the image forming apparatus according to the one embodiment of the present disclosure.
Figure 20:
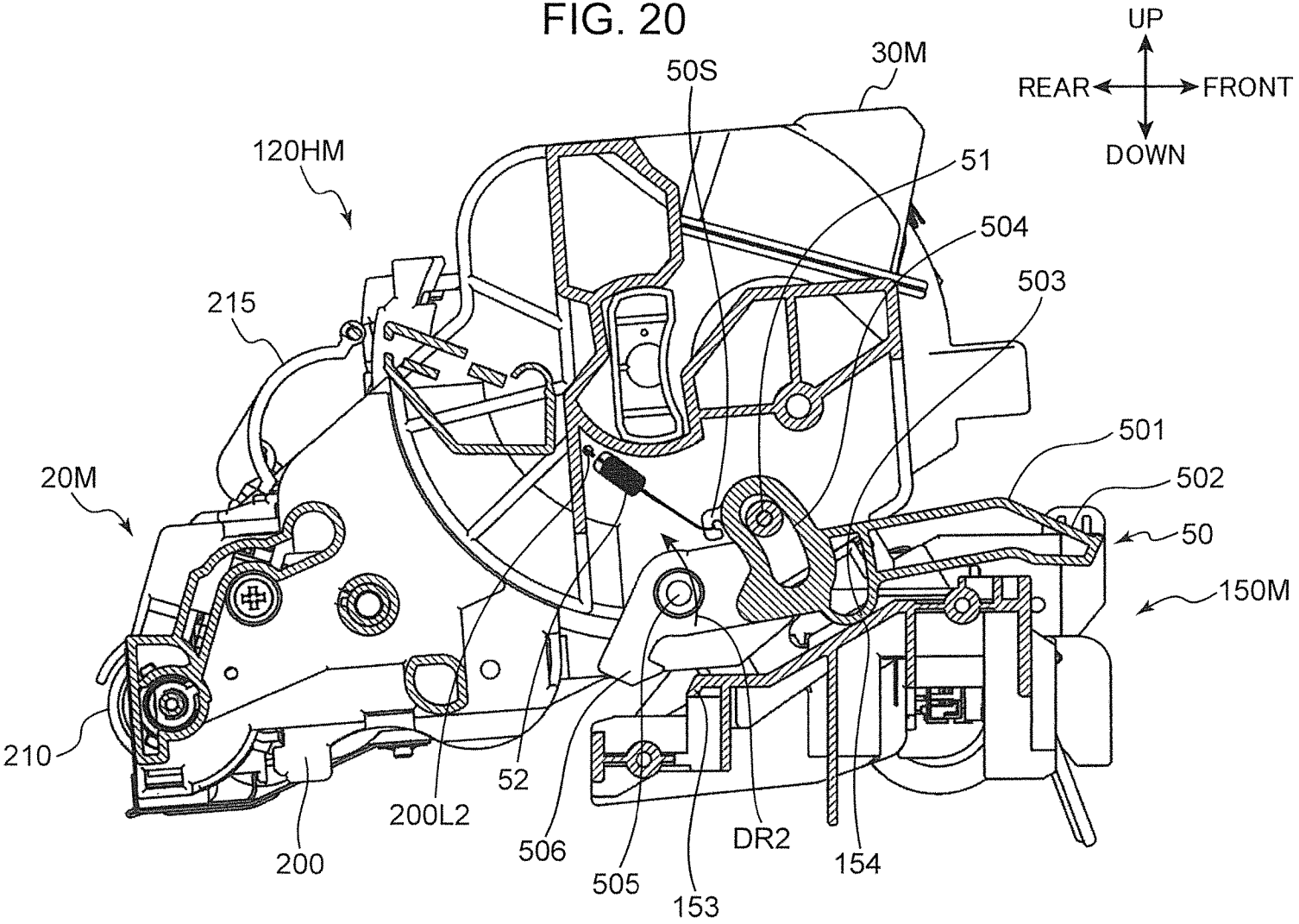
FIG. 20 is a sectional view of the image forming unit and the guide unit in the other image forming apparatus to be compared with the image forming apparatus according to the one embodiment of the present disclosure.

FIGS. 19 and 20 are sectional views of an image forming unit and a guide unit of another image forming apparatus to be compared with the image forming apparatus according to this embodiment. The other image forming apparatus includes an image forming unit 120HM and a body unit 150M provided in an unillustrated housing. The image forming unit 120HM includes a developing device 20M and a toner container 30M. A lock lever 50M is pivotably supported in an unillustrated housing of the developing device 20M. Note that, in FIGS. 19 and 20, members having similar structures and functions to those of FIG. 7 are denoted by the same reference signs as in FIG. 7.

When the image forming unit 120HM is locked at a predetermined position as shown in FIG. 19, a contact portion 503 of the lock lever 50M is spaced upwardly from a guide surface 154. In this case, if an operator presses a lever pressed portion 502 to remove the image forming unit 120HM (arrow DR1 of FIG. 19), the operator feels only a small load to pull a lever biasing spring 52 until the contact portion 503 comes into contact with the guide surface 154. Thus, when the contact portion 503 eventually comes into contact with the guide surface 154 as shown in FIG. 20, the operator tends to misunderstand, due to an increase of the load, that a pressing operation of the lock lever 50 has been completed. In this case, since the image forming unit 120HM is neither unlocked nor moved upward as indicated by an arrow DR2 of FIG. 20, surrounding components may be broken if the operator tries to forcibly pull out the image forming unit 120HM. On the other hand, since the first contact portion 503A of the contact portion 503 is in contact with the guide surface 154 as described above in this embodiment (FIG. 7), the operator can keep pressing the lever pressed portion 502 of the lock lever 50 while feeling a predetermined load from the initial stage of the pressing operation. Thus, it is suppressed that the operator takes his hand off from the lock lever 50 during the pressing operation.

When the lever pressed portion 502 is pressed (arrow DR1 of FIG. 7) from the state shown in FIGS. 7 and 10, the lock lever 50 rotates about the pivot portion 505 to disengage the hook 506 and the engaged portion 153. At this time, the first contact portion 503A of the contact portion 503 serves as a pivot, the pivot portion 505 serves as a weight point and the image forming unit 120H is pushed upwardly against biasing forces of the unit biasing springs 152 (FIG. 10), and the positioning of the image forming unit 120H by the positioning mechanisms 150S is released. More specifically, as the image forming unit 120H moves upward, the housing pressed portion 200K (FIG. 10) moves upward over the tip parts of the biasing projections 151 while compressing the unit biasing springs 152 (FIG. 11). As a result, the positioning of the image forming unit 120H by the positioning mechanisms 150S is released. In this embodiment, the distance (first distance) between the first contact portion 503A and the pivot portion 505 is set in advance such that the first contact portion 503A of the contact portion 503 serves as a pivot and the positioning of the image forming unit 120H is released by the lock lever 50 pushing up the image forming unit 120H.

When the lever pressed portion 502 is further pressed by the operator after the positioning by the positioning mechanisms 150S is released, a contact point of the contact portion 503 with the guide surface 154 gradually moves rearward and, eventually, the second contact portion 503B comes into contact with the guide surface 154 (FIG. 8). The image forming unit 120H moves upward by receiving the biasing forces of the unit biasing springs 152 (arrow DR2 of FIG. 8) and reaches the second position higher than the first position (FIG. 9) while the second contact portion 503B serves as a pivot and the pivot portion 505 serves as a weight point. As a result, the third contact portion 503C of the contact portion 503 comes into contact with the guide surface 154. In this embodiment, the distance (second distance) between the second contact portion 503B and the pivot portion 505 is set in advance such that the second contact portion 503B of the contact portion 503 serves as a pivot and the image forming unit 120H is pushed upwardly by an operation of the lock lever 50 to push up the image forming unit 120H.

Note that when the housing pressed portion 200K moves onto the biasing projections 151 as shown in FIG. 11, the biasing projections 151 receive the biasing forces of the unit biasing springs 152 and promote the push-up of the image forming unit 120H. Accordingly, the operator is not required to exert a large pressing force as compared to the case where the image forming unit 120H is pushed up (lock lever 50 is rotated) while the unit biasing springs 152 are compressed from the state shown in FIG. 10. Thus, in this embodiment, distances to the pivot portion 505 are set to increase in the order of the first contact portion 503A, the second contact portion 503B and the third contact portion 503C of the contact portion 503. In other words, a lever ratio using the pivot portion 505 as a weight point decreases in the order of the first contact portion 503A, the second contact portion 503B and the third contact portion 503C of the contact portion 503. Thus, a push-down amount of the lever pressed portion 502 can be converted into a larger push-up amount of the image forming unit 120H when the peripheries of the second and third contact portions 503B, 503C come into contact with the guide surface 154 than when the first contact portion 503A comes into contact with the guide surface 154. As just described, in this embodiment, the positioning by the positioning mechanisms 150S can be released and the movement of the image forming unit 120H can be promoted by the movement of the housing pressed portion 200K of the image forming unit 120H.

Note that the hook 506 comes into contact with the guide surface 154 (aforementioned horizontal surface) above the engaged portion 153 due to the own weight of the image forming unit 120H after the image forming unit 120H is pushed up in the direction of the arrow DR2 from the state shown in FIG. 8, whereby the image forming unit 120H is held at the second position. Thus, even if the operator takes his hand off from the lock lever 50, the re-engagement of the hook 506 with the engaged portion 153 is suppressed. Therefore, the operator can easily and reliably remove the image forming unit 120H (arrow DR3 of FIG. 11).

Figure 21:
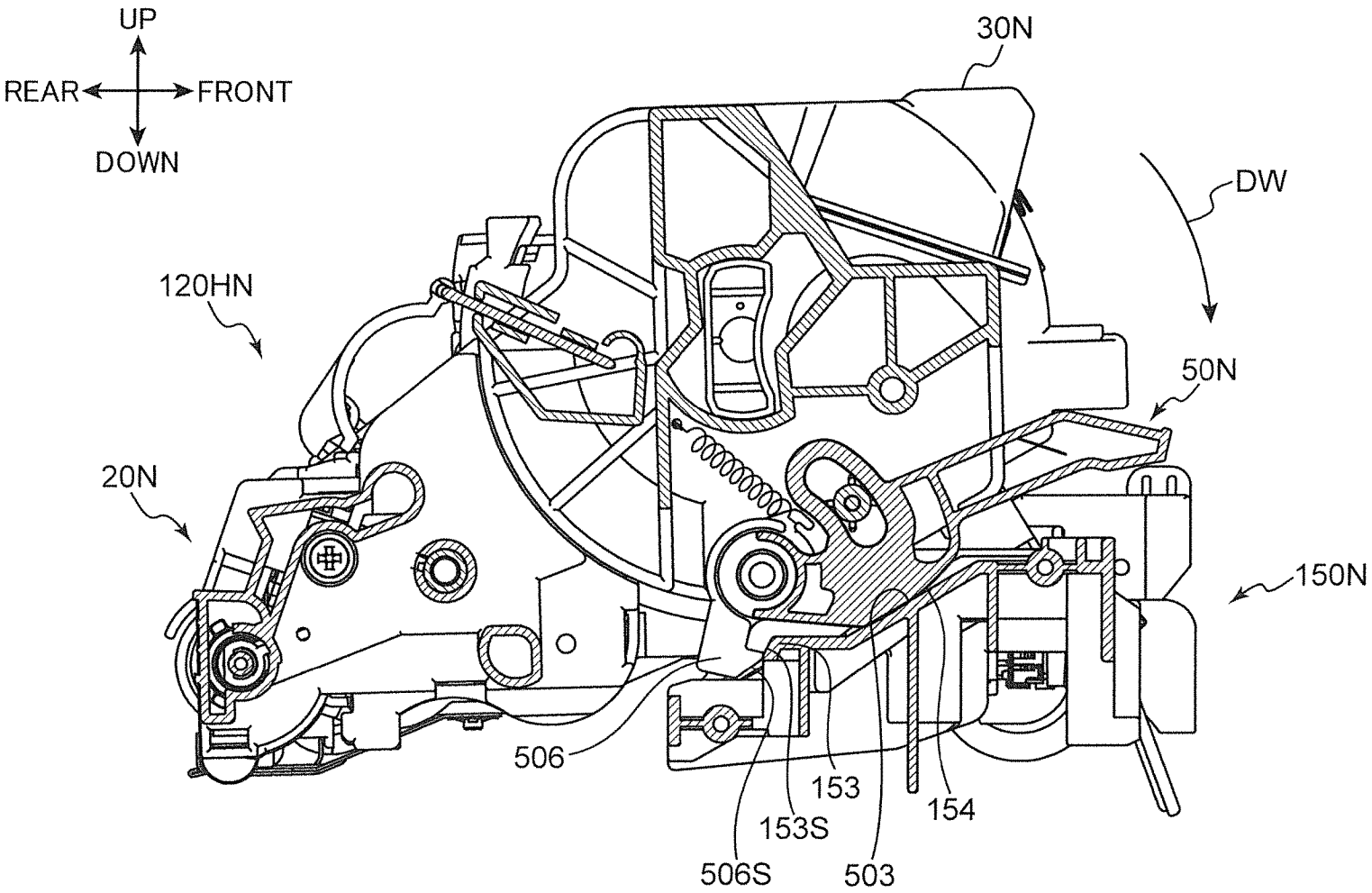
FIG. 21 is a sectional view of an image forming unit and a guide unit in another image forming apparatus to be compared with the image forming apparatus according to the one embodiment of the present disclosure.

On the other hand, it was found out that the following problem occurred with a structure in which the first contact portion 503A was already in contact with the guide surface 154 when the lever pressed portion 502 of the lock lever 50 is pressed by the operator as shown in FIG. 9. FIG. 21 is a sectional view of an image forming unit and a guide unit in another image forming apparatus to be compared with the image forming apparatus according to this embodiment. This other image forming apparatus includes an image forming unit 120HN and a body unit 150N provided in an unillustrated housing. The image forming unit 120HN includes a developing device 20N and a toner container 30N. A lock lever 50N is pivotably supported in an unillustrated housing of the developing device 20N. Note that, in FIG. 21, members having similar structures and functions to those of FIG. 7 are denoted by the same reference signs as in FIG. 7.

In the lock lever 50N shown in FIG. 21, a relative positional relationship of a contact portion 503 and a hook 506 is fixed. Thus, when the image forming unit 120HN is mounted into the housing and pushed down in a direction of an arrow DW of FIG. 21 while unit biasing springs 152 (FIG. 11) of positioning mechanisms 150S are compressed, the contact portion 503 comes into contact with a guide surface 154 and a hook tip part 506S of the hook 506 comes into contact with an inclined surface 153S of an engaged portion 153. When the lock lever 50N comes into contact with the body unit 150N simultaneously at two positions in this way, it is difficult to engage the hook 506 and the engaged portion 153, thereby presenting a problem that the mounting of the image forming unit 120HN is not stably realized.

Figure 12:
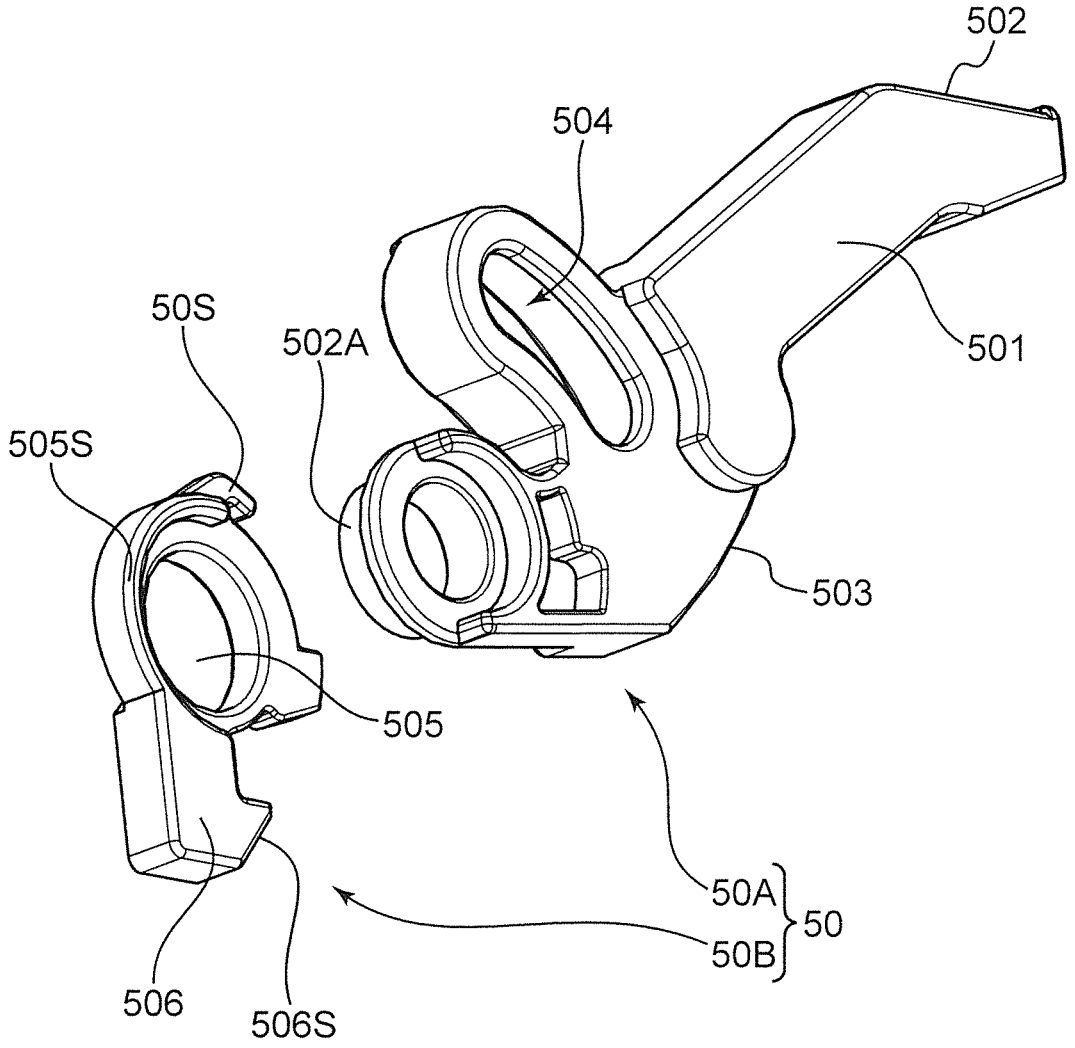
FIG. 12 is an exploded perspective view of the lever member according to the one embodiment of the present disclosure.
Figure 13:
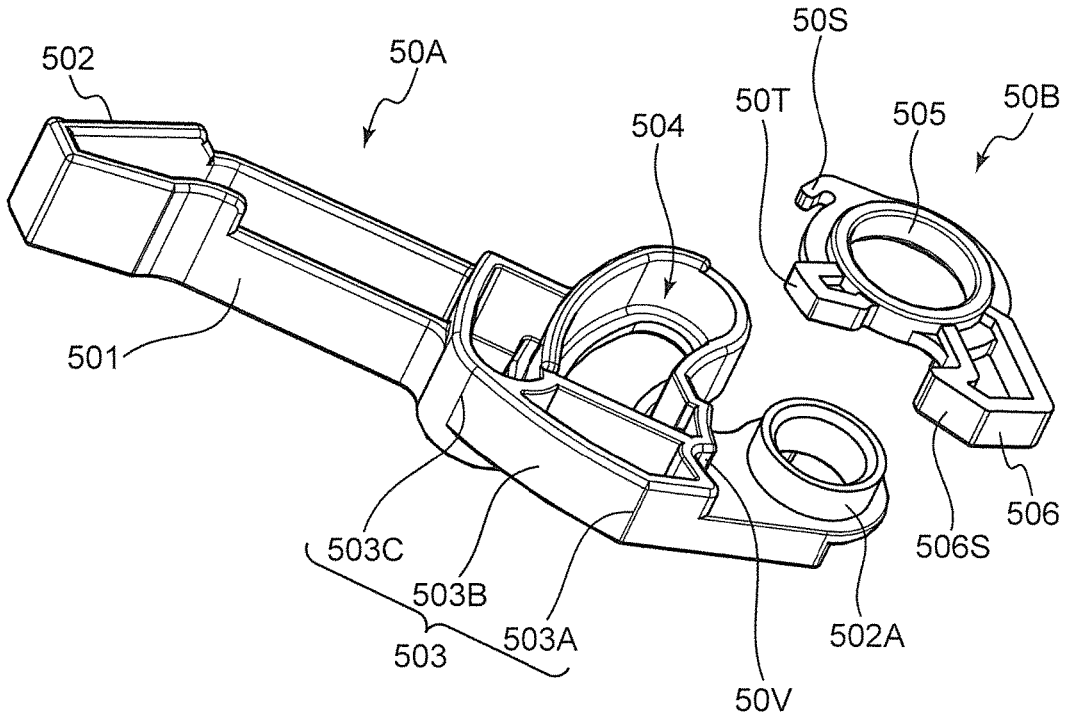
FIG. 13 is an exploded perspective view of the lever member according to the one embodiment of the present disclosure.
Figure 14:
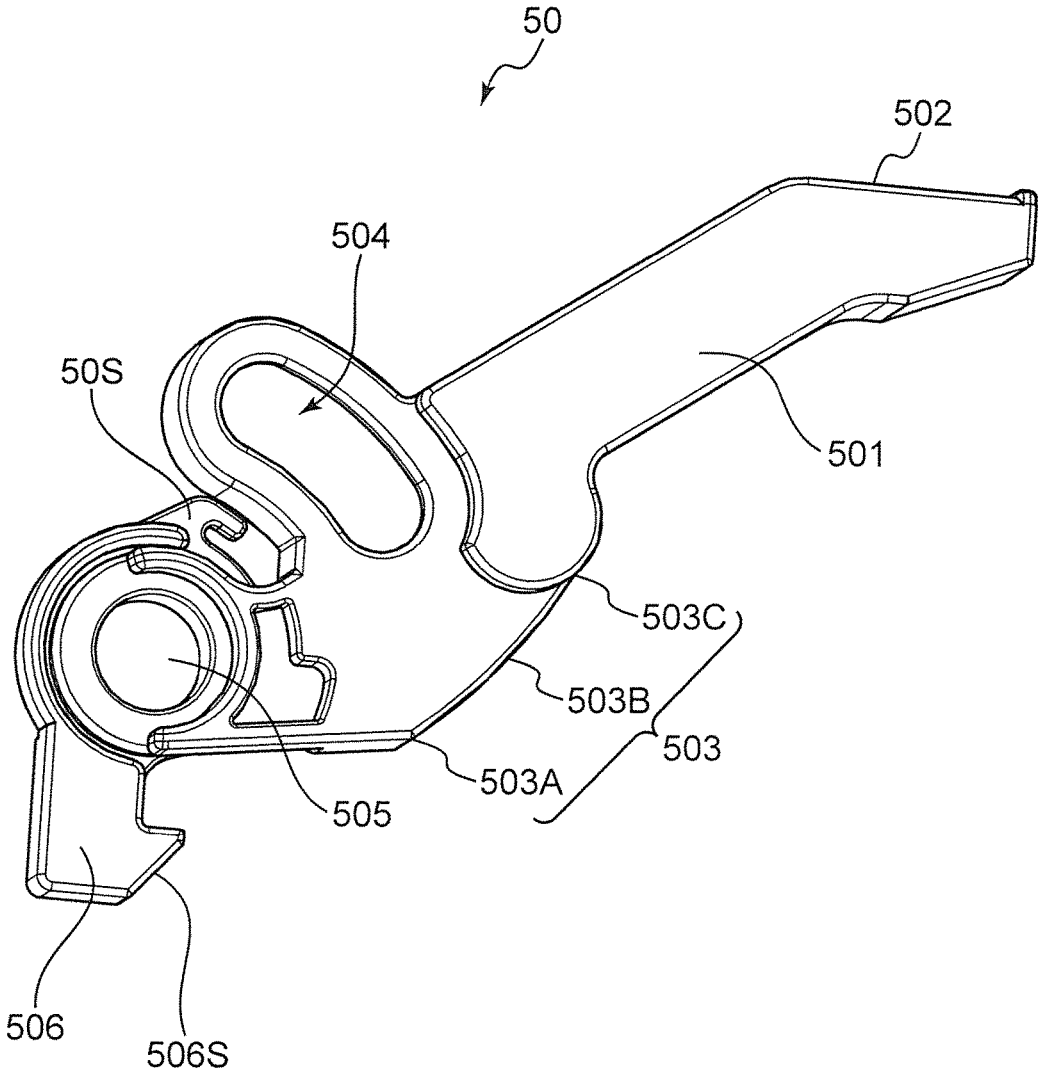
FIG. 14 is a perspective view of the lever member according to the one embodiment of the present disclosure.
Figure 15:
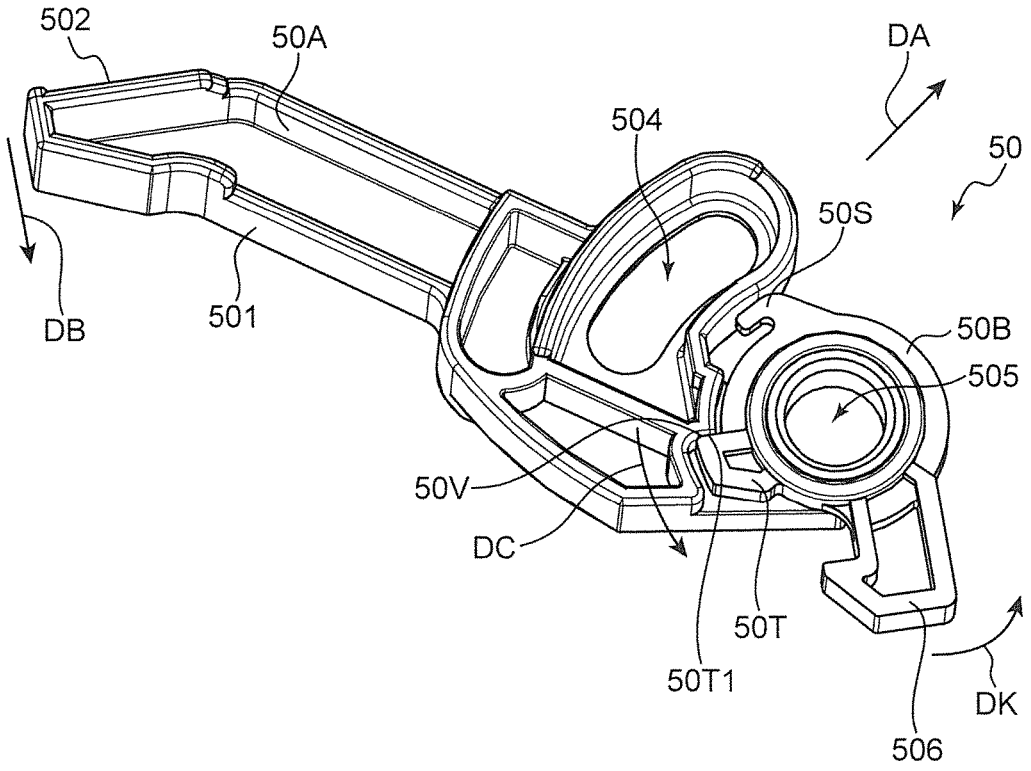
FIG. 15 is a perspective view of the lever member according to the one embodiment of the present disclosure.
Figure 16:
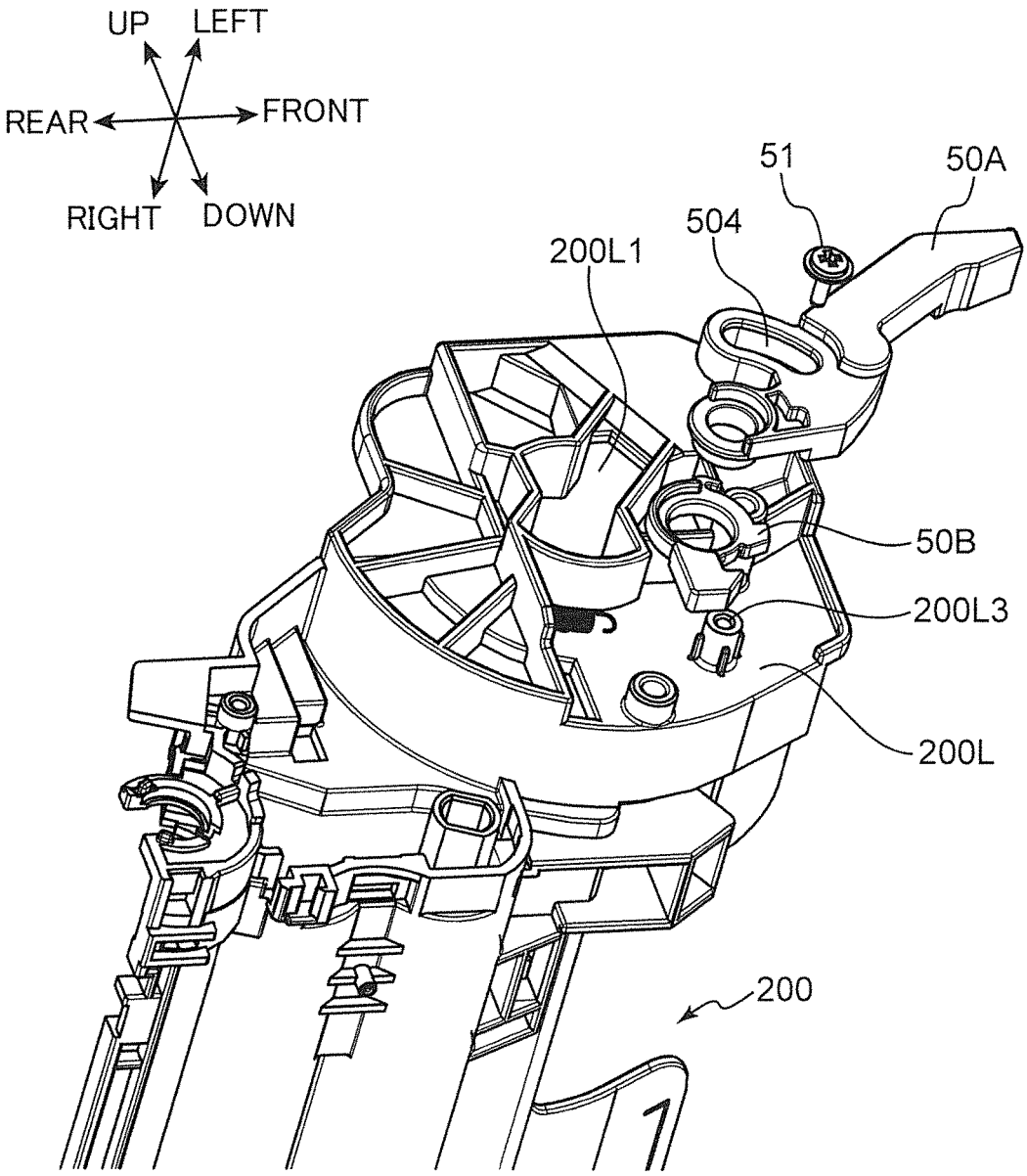
FIG. 16 is an exploded perspective view of the image forming unit and the lever member according to the one embodiment of the present disclosure.
Figure 17:
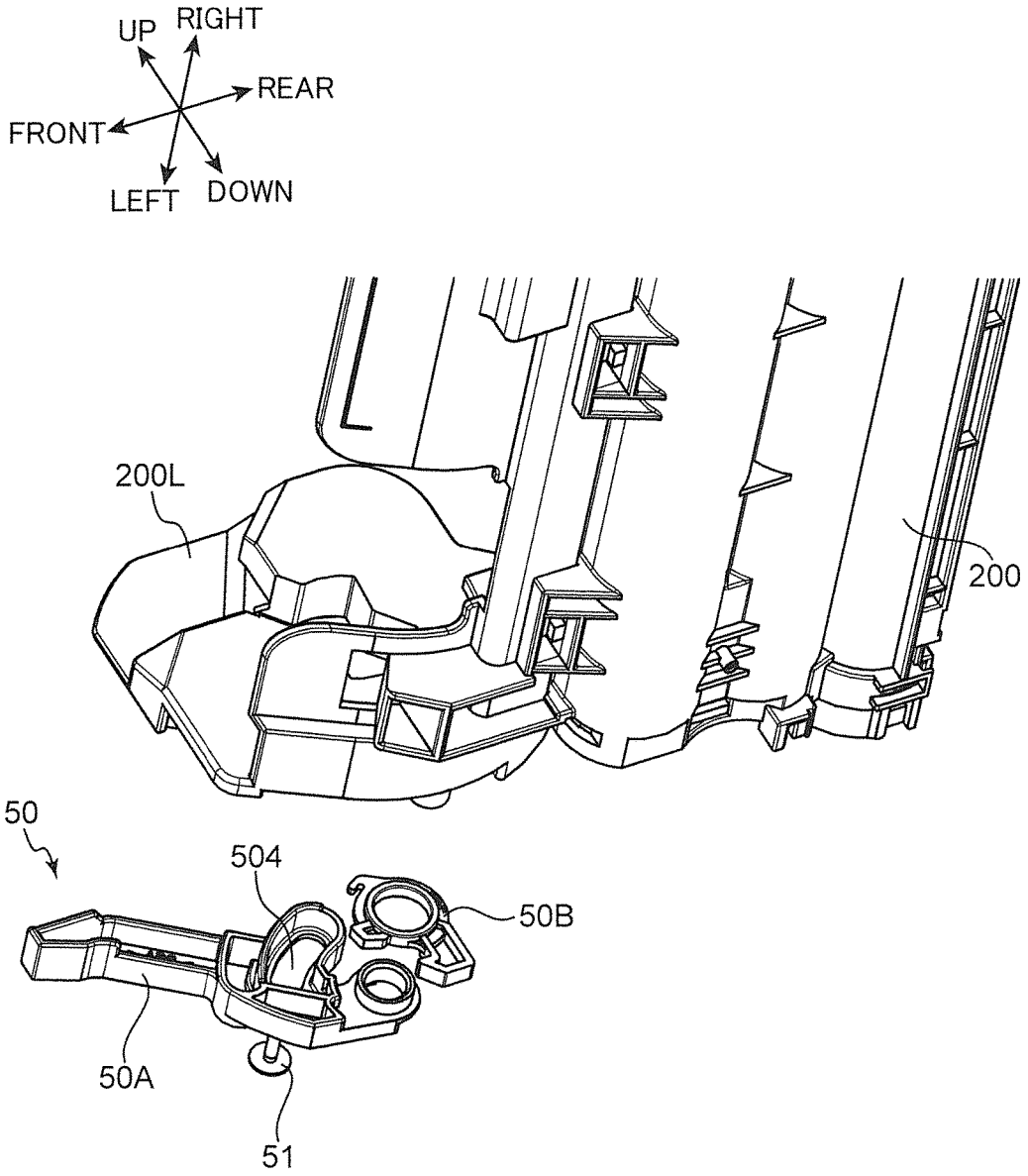
FIG. 17 is an exploded perspective view of the image forming unit and the lever member according to the one embodiment of the present disclosure.
Figure 18:
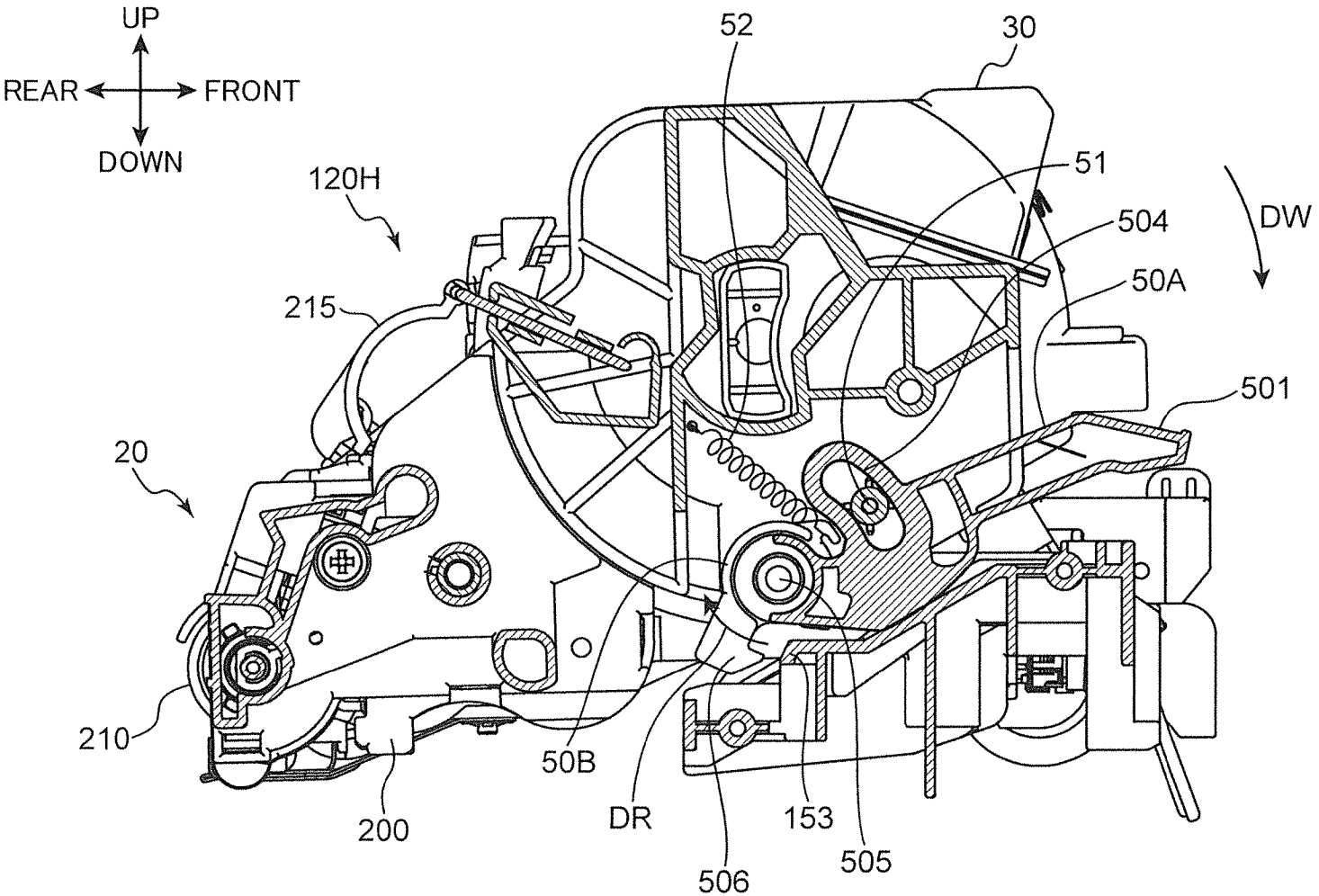
FIG. 18 is a sectional view of the image forming unit and the guide unit according to the one embodiment of the present disclosure showing a state where a hook is rotated.

To solve such a problem, the structure of the lock lever 50 has a further feature in this embodiment. FIGS. 12 and 13 are exploded perspective views of the lock lever 50 according to this embodiment. FIGS. 14 and 15 are perspective views of the lock lever 50. FIGS. 16 and 17 are exploded perspective views of the image forming unit 120H and the lock lever 50. FIG. 18 is a sectional view of the image forming unit 120H and the body unit 150 showing a state where the hook 506 of the lock lever 50 is rotated.

With reference to FIGS. 12 to 17, the lock lever 50 includes a lever body 50A and a hook portion 50B. Specifically, in this embodiment, the lock lever 50 is composed of two members. As shown in FIG. 12, the lever body 50A includes the arm portion 501, the lever pressed portion 502, the contact portion 503 and the guide groove 504 described above. On the other hand, the hook portion 50B includes the lever-side locking portion 50S, the pivot portion 505 and the hook 506 described above.

When a hollow cylindrical inserting flange 502A formed on one end part of the lever body 50A is inserted into the pivot portion 505 of the hook portion 50B, the hook portion 50B is rotatable with respect to the lever body 50A. Specifically, the hook 506 is rotatable about the pivot portion 505. At this time, an arcuate guide rib 5055 arranged around the pivot portion 505 slides against the inserting flange 502A, thereby guiding the rotation of the hook 506.

Further, with reference to FIG. 13, the lever body 50A includes a body contact portion 50V. The body contact portion 50V is a wall part arranged between the guide groove 504 and the inserting flange 502A. On the other hand, the hook portion 50B includes a hook-side contact portion 50T. The hook-side contact portion 50T is a projecting piece projecting radially outward from the pivot portion 505 and, as shown in FIG. 15, has a substantially trapezoidal shape. Further, the hook-side contact portion 50T is arranged at a predetermined interval from the lever-side locking portion 50S in a rotational direction about the pivot portion 505. The hook-side contact portion 50T and the body contact portion 50V in this embodiment constitute an interlocking portion. The interlocking portion has a function of rotating the hook 506 integrally with the lever pressed portion 502 when the lever pressed portion 502 is rotated in a direction of an arrow DB of FIG. 15 (second rotational direction opposite to a first rotational direction) about the pivot portion 505.

As shown in FIGS. 14 to 17, the lock lever 50 is pivotably mounted on the housing left wall 200L by mounting the hook portion 50B on the lever body 50A and fastening the guide screw 51 inserted into the guide groove 504 to a stud 200L3 projecting form the housing left wall 200L. Further, the hook portion 50B is rotatable with respect to the lever body 50A.

With reference to FIG. 15, when the lock lever 50 is mounted on the housing left wall 200L, the hook portion 50B is biased in a direction of an arrow DA of FIG. 15 by the lever biasing spring 52 provided between the lever-side locking portion 50S and the housing-side locking portion 200L2 (FIG. 7). At this time, the lever biasing spring 52 biases the hook 506 in the first rotational direction (direction opposite to that of an arrow DK of FIG. 15) about the pivot portion 505 so that the hook 506 engages the engaged portion 153 (FIG. 7). Then, a contact surface 50T1 of the hook-side contact portion 50T comes into contact with the body contact portion 50V, whereby the lever body 50A is also biased in the first rotational direction by a biasing force of the lever biasing spring 52.

Further, in FIG. 15, when the lever pressed portion 502 of the lever body 50A is pressed in the direction of the arrow DB by the operator, the body contact portion 50V presses the contact surface 50T1 of the hook-side contact portion 50T in the direction of the arrow DC, wherefore the hook 506 rotates in the direction of the arrow DK. Specifically, when the lock lever 50 is unlocked by the operator, the lever body 50A and the hook portion 50B can integrally rotate.

Further, in FIG. 15, the hook portion 50B can singly rotate in the direction of the arrow DK with respect to the lever body 50A with no operation force applied to the lever body 50A. At this time, the hook portion 50B rotates about the pivot portion 505 against the biasing force of the lever biasing spring 52.

Also in such a configuration, when the image forming unit 120H is mounted into the housing 101 and pushed down in the direction of the arrow DW while compressing the unit biasing springs 152 (FIG. 11) of the positioning mechanisms 150S as shown in FIG. 18, the contact portion 503 may come into contact with the guide surface 154 and the hook tip part 506S of the hook 506 may come into contact with the inclined surface 153S of the engaged portion 153 (see FIG. 21). Even in such a case, since the hook portion 50B is rotatable with respect to the lever body 50A in this embodiment, the hook 506 can temporarily rotate in a direction away from the engaged portion 153 as shown by an arrow DR of FIG. 18. Thus, the image forming unit 120H can be pushed downwardly and the temporarily rotated hook 506 can return to an original posture by the biasing force of the lever biasing spring 52 with the contact portion 503 held in contact with the guide surface 154. At this time, the hook 506 is engaged with the engaged portion 153 and the image forming unit 120H is fixed at the first position in the housing 101.

As just described, in this embodiment, even if the hook 506 and the contact portion 503 respectively simultaneously come into contact with the engaged portion 153 and the guide surface 154 when the image forming unit 120H is mounted at the first position, the mounting of the image forming unit 120H is smoothly realized by the rotation of the hook 506.

Further, in this embodiment, the lever biasing spring 52 biases the hook 506 in the first rotational direction about the pivot portion 505 such that the hook 506 engages the engaged portion 153. Thus, the hook 506 can be maintained in a posture to engage the engaged portion 153 by the biasing force of the lever biasing spring 52. Thus, it is suppressed that the hook 506 and the engaged portion 153 are inadvertently disengaged.

Further, in this embodiment, the interlocking portion composed of the hook-side contact portion 50T and the body contact portion 50V is arranged. Thus, even if the hook 506 is rotatable about the pivot portion 505, the hook 506 and the engaged portion 153 can be smoothly disengaged as the lock lever 50 is pressed.

Further, according to this embodiment, the lock lever 50 can change the posture thereof between the first and second postures by being pivoted. By the engagement of the hook 506 of the lock lever 50 with the engaged portion 153 of the body unit 150, the image forming unit 120H is locked at the first position. Further, the lever pressed portion 502 of the lock lever 50 is pressed, whereby the image forming unit 120H is unlocked and allowed to be removed from the housing 101 along the predetermined removing direction. As a result, the image forming unit 120H can be easily and reliably positioned, mounted and removed. Further, since the first contact portion 503A comes into contact with the guide surface 154 when the operator presses the lock lever 50, a predetermined pressing load is generated at the lock lever 50. Thus, the occurrence of an operation error by the operator is suppressed as compared to the case where the lock lever 50 has a play.

Further, the first contact portion 503A functions as a pivot, whereby the positioning by the positioning mechanisms 150S can be easily released against the biasing forces of the unit biasing springs 152. Furthermore, the hook 506 is rotatable about the pivot portion 505. Thus, even if the hook 506 and the contact portion 503 respectively simultaneously come into contact with the engaged portion 153 and the guide surface 154 when the image forming unit 120H is mounted at the first position, the mounting of the image forming unit 120H is smoothly realized by the rotation of the hook 506.

Further, since the lever ratio of the first contact portion 503A is set to be relatively large in the contact portion 503, the positioning by the positioning mechanisms 150S can be easily released against the biasing forces of the unit biasing springs 152. Further, since the lever ratio of the second contact portion 503B is set to be relatively small, a displacement amount of the lock lever 50 can be increased and a push-up amount for the image forming unit 120H can be increased when the image forming unit 120H is pushed while receiving the biasing forces of the unit biasing springs 152. Note that a largest force is necessary for a movement of the image forming unit 120H when a change is made from the state of FIG. 10 to the state of FIG. 11. Thus, a force for pulling up the image forming unit 120H may be relatively small after the image forming unit 120H moves over the tip parts of the biasing projections 151. The lever ratio of the second contact portion 503B is set to be small to increase a displacement of the image forming unit 120H, i.e. to secure a push-up displacement of the lock lever 50 after the image forming units 120H moves over the above tip parts.

Further, in this embodiment, the first, second and third contact portions 503A to 503C are coupled by the arc of the contact portion 503. Thus, the operator can unlock the image forming unit 120H and move the image forming unit 120H from the first position to the second position by continuously pressing the lock lever 50.

The printer 100 with the image forming unit 120H according to the embodiment of the present disclosure has been described above. According to such a configuration, the printer 100 is provided which can easily and reliably position, mount and remove the image forming unit 120H. Further, even with the toner container 30 attached to the developing device 20, the developing device 20 can be easily and reliably positioned, mounted and removed. Note that the present disclosure is not limited to this and the following modifications can be, for example, employed.

(1) Although the image forming unit 120H includes the developing device 20 and the toner container 30 in the above embodiment, the present disclosure is not limited to this. The image forming unit 120H may be composed only of the developing device 20 or the image forming unit 120H may include the photoconductive drum 121.

(2) Although the contract rollers 211 are provided as interval holding members in the above embodiment, the present disclosure is not limited to this. Interval holding members having a shape other than a roller shape may be provided.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an apparatus body;

an image forming unit mountable into and removable from the apparatus body along predetermined mounting and removing directions;

a guide unit arranged in the apparatus body and configured to guide the mounting and removal of the image forming unit;

a positioning mechanism arranged in the guide unit, including a first biasing member and a unit contact portion configured to come into contact with the image forming unit by receiving a biasing force of the first biasing member, and configured to bias the image forming unit mounted at a first position in the apparatus body and position the image forming unit; and a lever member pivotably provided on the image forming unit and capable of changing the posture thereof between a first posture for locking the image forming unit at the first position in the apparatus body and a second posture for unlocking the image forming unit and allowing the image forming unit to be removed from the apparatus body along the removing direction;

wherein:

the guide unit includes:

a guide surface configured to guide the image forming unit; and an engaged portion arranged more forward than the guide surface in the mounting direction of the image forming unit;

the lever member includes:

a pivot portion serving as a pivot in a pivotal movement;

a pressed portion to be pressed to remove the image forming unit from the apparatus body;

a hook arranged on a side opposite to the pressed portion across the pivot portion, rotatable about the pivot portion and engageable with the engaged portion of the guide unit; and a contact portion arranged between the pivot portion and the pressed portion and capable of coming into contact with the guide surface of the guide unit;

the contact portion has a first contact portion arranged at a first distance from the pivot portion and configured to come into contact with the guide surface with the hook of the lever member in the first posture engaged with the engaged portion and the image forming unit locked at the first position;

the first distance of the first contact portion is set such that, when the pressed portion of the lever member is pressed with the image forming unit locked at the first position, the lever member rotates about the pivot portion, the hook and the engaged portion are disengaged, the image forming unit is pushed upwardly against the biasing force of the first biasing member with the first contact portion serving as a pivot and the pivot portion serving as a weight point and the positioning of the image forming unit by the positioning mechanism is released.

2. An image forming apparatus according to claim 1, further comprising:

a second biasing member configured to bias the hook in a first rotational direction about the pivot portion such that the hook engages the engaged portion.

3. An image forming apparatus according to claim 2, wherein:

the lever member includes an interlocking portion configured to rotate the hook integrally with the pressed portion when the pressed portion is rotated about the pivot portion in a second rotational direction opposite to the first rotational direction.

4. An image forming apparatus according to claim 1, wherein:

the contact portion further has a second contact portion arranged at a second distance longer than the first distance from the pivot portion on a side closer to the pressed portion than the first contact portion, capable of coming into contact with the guide surface and spaced from the guide surface with the image forming unit locked at the first position; and the second distance of the second contact portion is set such that, when the pressed portion is further pressed after the positioning by the positioning mechanism is released, the second contact portion comes into contact with the guide surface, the image forming unit reaches a second position higher than the first position by receiving the biasing force of the first biasing member with the second contact portion serving as a pivot and the pivot portion serving as a weight point and becomes removable from the apparatus body along the removing direction.

5. An image forming apparatus according to claim 4, wherein:

the contact portion has an arc shape when viewed in a cross-section perpendicular to an axial center direction of the pivot portion; and the first and second contact portions are coupled by the arc.

6. An image forming apparatus according to claim 1, wherein:

the unit contact portion of the positioning mechanism has a tapered part tapered along the mounting direction of the image forming unit into the apparatus body;

the image forming unit includes a unit pressed portion to be pressed by the unit contact portion; and the unit pressed portion of the image forming unit arranged at the first position is arranged to face the unit contact portion such that, when the image forming unit is pushed upwardly against the biasing force of the first biasing member with the first contact portion serving as a pivot and the pivot portion serving as a weight point, the unit pressed portion moves over the tip part of the unit contact portion while compressing the first biasing member, whereby the positioning of the image forming unit by the positioning mechanism is released and the unit contact portion promotes the push-up of the image forming unit by receiving the biasing force of the first biasing member.

7. An image forming apparatus according to claim 1, further comprising:

an image carrier rotatably arranged in the apparatus body and configured such that an electrostatic latent image is formed on a peripheral surface; wherein:

the image forming unit includes a developing device having a developing roller configured to supply developer to the image carrier;

the positioning mechanism biases the image forming unit in a direction to bring the developing roller closer to the image carrier; and the developing roller is arranged at a predetermined interval from the image carrier when the image forming unit is positioned at the first position in the apparatus body.

8. An image forming apparatus according to claim 7, wherein:

the developing device includes interval holding members arranged on both axial end parts of the developing roller and configured to come into contact with the peripheral surface of the image carrier.

9. An image forming apparatus according to claim 7, wherein:

the image forming unit further includes a developer storage container attachable to and detachable from the developing device and mountable into the apparatus body integrally with the developing device.

* * * * *